US012279746B2

(12) United States Patent
Lin

(10) Patent No.: US 12,279,746 B2
(45) Date of Patent: Apr. 22, 2025

(54) BASE STATION, CLEANING SYSTEM, AND METHOD FOR SELF-CHECKING THEREOF

(71) Applicants: YUNJING INTELLIGENCE (SHENZHEN) CO., LTD., Shenzhen (CN); YUNJING INTELLIGENCE INNOVATION (SHENZHEN) CO., LTD., Shenzhen (CN)

(72) Inventor: Xiaolong Lin, Shenzhen (CN)

(73) Assignees: YUNJING INTELLIGENCE (SHENZHEN) CO., LTD., Shenzhen (CN); YUNJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/212,183

(22) Filed: Jun. 21, 2023

(65) Prior Publication Data

US 2023/0329504 A1 Oct. 19, 2023

Related U.S. Application Data

(63) Continuation of application No. PCT/CN2022/143925, filed on Dec. 30, 2022.

(30) Foreign Application Priority Data

Dec. 31, 2021 (CN) ..... 202111683027.1

(51) Int. Cl.
*A47L 9/28* (2006.01)

(52) U.S. Cl.
CPC ..... *A47L 9/2889* (2013.01); *A47L 9/2873* (2013.01); *A47L 2201/026* (2013.01)

(58) Field of Classification Search
None
See application file for complete search history.

(56) References Cited

U.S. PATENT DOCUMENTS 5,913,614 A * 6/1999 Smith ..... E03B 1/04 236/12.12
9,567,736 B1 2/2017 Achterman
(Continued)

FOREIGN PATENT DOCUMENTS

CN 101853951 A 10/2010
CN 202969469 U 6/2013
(Continued)

OTHER PUBLICATIONS

First Office Action issued in related Chinese Application No. 202111683027.1, mailed Sep. 20, 2022, 12 pages.
(Continued)

*Primary Examiner* — Natasha N Campbell
*Assistant Examiner* — Pradhuman Parihar
(74) *Attorney, Agent, or Firm* — BAYES PLLC

(57) ABSTRACT

The present disclosure provides a base station for a mobile cleaner. The base station includes a dock, a cleaning unit, a water assembly, and a self-checking module. The dock is configured to accommodate the mobile cleaner. The cleaning unit is configured to clean the mobile cleaner accommodated in the dock. The water supply assembly is configured to supply water to the cleaning unit from a water source. The self-checking module is configured to detect a malfunction regarding conveyance of water from the water source to the cleaning unit.

8 Claims, 11 Drawing Sheets

(56) References Cited

U.S. PATENT DOCUMENTS

| | | | | |
|---|---|---|---|---|
| 2009/0078290 | A1* | 3/2009 | Addicks | A47L 11/4083 134/21 |
| 2011/0197920 | A1* | 8/2011 | Kenowski | B08B 9/027 134/10 |
| 2019/0069749 | A1 | 3/2019 | Wurm et al. | |
| 2020/0033168 | A1* | 1/2020 | Leaders | G01F 1/663 |
| 2020/0121153 | A1* | 4/2020 | Letsky | A47L 9/2873 |
| 2021/0030239 | A1* | 2/2021 | Kang | A47L 11/4038 |
| 2021/0369072 | A1* | 12/2021 | Gao | B08B 3/02 |
| 2022/0250899 | A1* | 8/2022 | Li | B60S 5/00 |

FOREIGN PATENT DOCUMENTS

| | | | |
|---|---|---|---|
| CN | 106196619 | A | 12/2016 |
| CN | 206612594 | U | 11/2017 |
| CN | 107576346 | A | 1/2018 |
| CN | 108013845 | A | 5/2018 |
| CN | 108784372 | A | 11/2018 |
| CN | 109445475 | A | 3/2019 |
| CN | 110597200 | A | 12/2019 |
| CN | 111265165 | A | 6/2020 |
| CN | 112754371 | A | 5/2021 |
| CN | 112914442 | A | 6/2021 |
| CN | 113017478 | A | 6/2021 |
| CN | 113774997 | A | 12/2021 |
| EP | 3542695 | A1 | 9/2019 |
| JP | H07174593 | A | 7/1995 |
| JP | 2007138643 | A | 6/2007 |
| JP | 2010238590 | A | 10/2010 |
| JP | 2018100575 | A | 6/2018 |
| JP | 2020017507 | A | 1/2020 |

OTHER PUBLICATIONS

Second Office Action issued in related Chinese Application No. 202111683027.1, mailed Feb. 4, 2023, 12 pages.

International Search Report issued in corresponding International Application No. PCT/CN/2022/143925, mailed Apr. 5, 2023, 6 pages.

* cited by examiner

200

605

BASE STATION, CLEANING SYSTEM, AND METHOD FOR SELF-CHECKING THEREOF

CROSS-REFERENCE TO RELATED APPLICATIONS

The present application is a continuation of International Application No. PCT/CN2022/143925, filed on Dec. 30, 2022, and also claims the benefit of priority to Chinese Patent Application No. 202111683027.1, filed on Dec. 31, 2021, the entire contents of which are incorporated herein by reference.

BACKGROUND

The present disclosure relates to a base station, a cleaning system, and a method for self-checking of the base station and the cleaning system. In particular, a water supply operation in the base station and the cleaning system, and self-checking thereof are disclosed herein.

For most cleaning devices using water that are currently on the market, such as a base station with a cleaning robot, a user must add clean water manually. Thus, there is a need to constantly inspect the amount or cleanliness of the water in the cleaning device in order to make sure that the cleaning can be carried out with sufficient water supply, or the cleaning result can be satisfactory. Moreover, the removal and refilling of the water is also performed manually, further exacerbating user's inconvenience of using such devices. Thus, improvement over the existing design is contemplated.

SUMMARY

Embodiments of the present disclosure provide a base station for a mobile cleaner. The base station includes a dock, a cleaning unit, a water assembly, and a self-checking module. The dock is configured to accommodate the mobile cleaner. The cleaning unit is configured to clean the mobile cleaner accommodated in the dock. The water supply assembly is configured to supply water to the cleaning unit from a water source. The self-checking module is configured to detect a malfunction regarding conveyance of water from the water source to the cleaning unit.

Embodiments of the present disclosure also provide a cleaning system. The cleaning system includes a base station, a power supply assembly, and a mobile cleaner. The base station includes a dock, a cleaning unit, a water supply assembly, and a self-checking module. The power supply assembly is configured to supply power to the base station. The dock is configured to accommodate the mobile cleaner and charge the mobile cleaner via the power supply assembly. The cleaning unit is configured to clean the mobile cleaner accommodated in the dock. The water supply assembly is configured to supply water to the cleaning unit from a water source. The self-checking module is configured to detect a malfunction regarding conveyance of water from the water source to the cleaning unit.

Embodiments of the present disclosure further provide a method for self-checking a base station for a mobile cleaner. The base station includes a water supply assembly configured to supply water to a cleaning unit from a water source. The method includes detecting, by a self-checking module, a malfunction regarding conveyance of water from the water source to the cleaning unit.

It is to be understood that both the foregoing general description and the following detailed description are exemplary and explanatory only and are not restrictive of the present disclosure, as claimed.

BRIEF DESCRIPTION OF DRAWINGS

The accompanying drawings, which are incorporated herein and form a part of the specification, illustrate aspects of the present disclosure and, together with the description, further explain the present disclosure and to enable a person skilled in the pertinent art to make and use the present disclosure.

Figure 1:
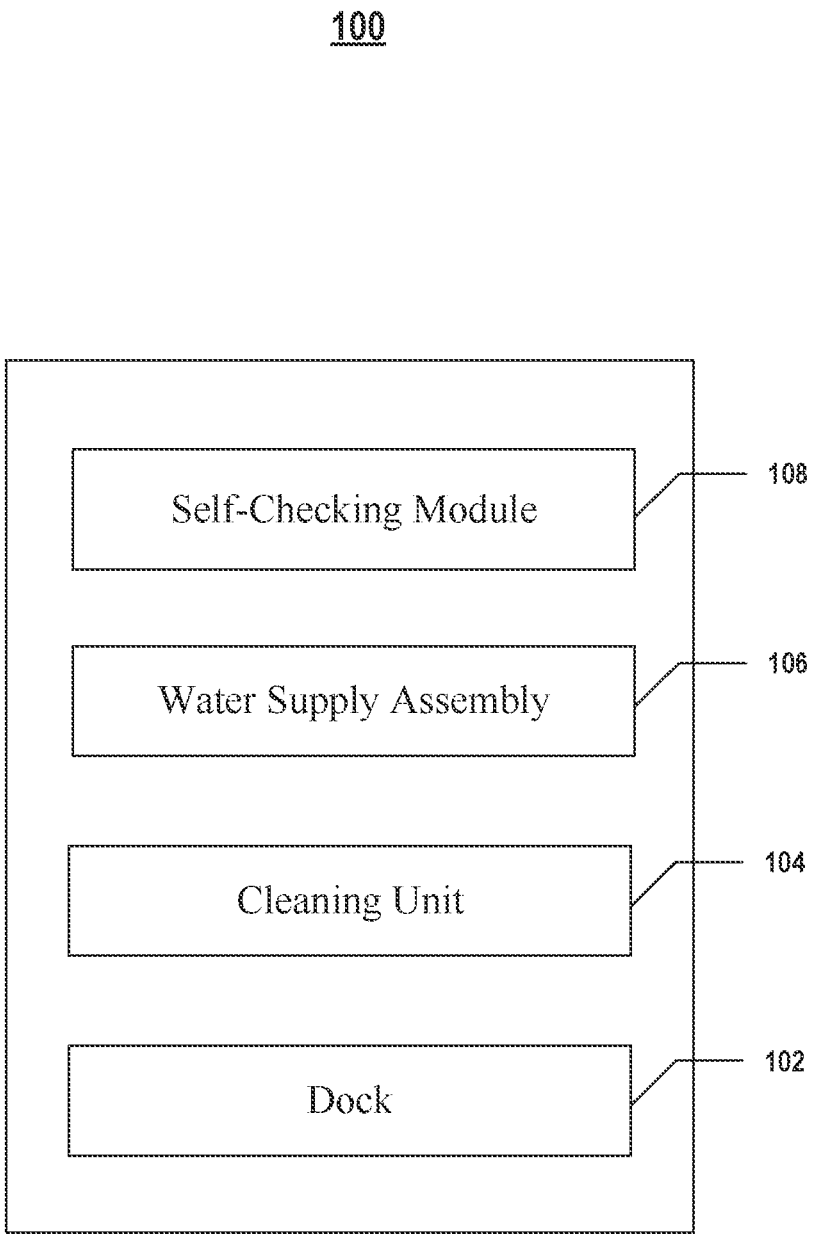
FIG. 1 illustrates a block diagram of an exemplary base station, according to some aspects of the present disclosure.

Aspects of the present disclosure will be described with reference to the accompanying drawings.

DETAILED DESCRIPTION

Although specific configurations and arrangements are discussed, it should be understood that this is done for illustrative purpose only. As such, other configurations and arrangements can be used without departing from the scope of the present disclosure. Also, the present disclosure can also be employed in a variety of other applications. Functional and structural features as described in the present disclosures can be combined, adjusted, and modified with one another and in ways not specifically depicted in the drawings, such that these combinations, adjustments, and modifications are within the scope of the present disclosure.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part upon context. Further, the terms "comprises," "comprising," "including," and "having" are intended to be inclusive and mean that there may be additional elements other than the listed elements.

Terms such as "upper," "lower," "inner," "outer," "front," "rear," and variations thereof herein are used for ease of description to explain the positioning of one element relative to a second element, and are not intended to be limiting to a specific orientation or position.

Terms such as "first," "second," and variations thereof herein are used to describe various elements, regions, sections, etc. and are not intended to be limiting.

Terms such as "connect," "couple," "communication with," and variations thereof herein are used broadly and encompass direct and indirect connections, communication and mountings, and are not restricted to electrical, physical, or mechanical attachments, connections, or mountings.

Now turn to the embodiments of the present disclosure. One way to resolve the abovementioned problem of manually removing and refilling water is to provide the cleaning device with an automatic water supply assembly. The automatic water supply assembly is connected to a water source and supplies water to the cleaning unit automatically, making the operation simpler and easier for the user. For example, the water supply assembly connects a water source with a water tank of the base station. The water supply assembly can detect an amount of water in the water tank, and refill the water tank if the amount of water is lower than a preset value. On one hand, user experience is enhanced because the user does not have to constantly monitor the water level in the water tank and refill the water manually; on the other hand, the addition of the water supply assembly increases the complexity of the cleaning device, thus increasing the possibility of malfunction and the difficulty to identify the malfunction regarding water conveyance. Sometimes it is also difficult to determine whether the water supply functions properly at a certain time. Also, incorrect installation of the automatic water supply assembly is unable to be detected before or after being delivered to a downstream user. Moreover, maintenance of the cleaning device also takes time due to the time and labor spent in manually identifying the type of malfunction of the water supply.

To further enhance the automation of water supply in such cleaning devices, especially in terms of automatically identifying and notifying the type of malfunction regarding water conveyance, the present disclosure introduces a base station for a mobile cleaner, the base station having a water supply assembly and a self-checking module. The self-checking module can detect whether there is a malfunction regarding conveyance of water from the water source to the cleaning unit, and identify the specific type and details of the malfunction if there is one. When the type of malfunction is identified, the self-checking module is able to send out a warning signal correlated to the type of malfunction so identified, and to notify the user of the malfunction. As a result, the efficiency of malfunction detection is significantly improved and the complexity of operating the cleaning device is mitigated.

FIG. 1 is a block diagram of an exemplary base station 100 for a mobile cleaner, according to some aspects of the present disclosure. The mobile cleaner can be any type of a cleaner that is detachable from the base station 100. For example, the mobile cleaner can be a mobile cleaning robot configured to move automatically above a two-dimensional area and clean up a surfaces it roams over. The mobile cleaner may sweep, mop, wash, or vacuum the surfaces, or perform any combination of two or more of the operations. A mobile cleaner capable of mopping and vacuuming is also known as a vacuum-mop robot. With the assistance of a processor and various sensors, the mobile cleaner may also survey the environment around its working area, plan its traveling trajectory in advance, and conduct obstacle avoidance while roaming. In another example, the mobile cleaner can be a handheld vacuum configured to clean up surfaces it passes over or approaches within a certain distance. The handheld vacuum may not be self-movable, but may be carried around by a user. The type of the mobile cleaner is not limited to the above examples. It is noted that the mobile cleaner and the base station 100 are both parts of a cleaning system according to the present disclosure, but each is an independent part from the other.

According to the present disclosure, the base station 100 may include a dock 102, a cleaning unit 104, a water supply assembly 106, and a self-checking module 108, as shown in FIG. 1. The dock 102 may be configured to accommodate the mobile cleaner. In some embodiments, the dock 102 may confine or fixate the mobile cleaner to the base station 100 to prevent it from unintended detachment from the base station 100. The cleaning unit 104 may be configured to clean the mobile cleaner when it is accommodated in the dock. The cleaning may be carried out by water supplied from the water supply assembly 106. The water supply assembly 106 may convey water from a water source to the cleaning unit 104. It is understood that the present disclosure is not limited to conveyance of water, and other suitable types of liquid or fluid (e.g., soapy water, laundry solution, etc.) may also be conveyed. The description herein uses the water as an example, and the same description applies to other types of liquid or fluid as well. In some embodiments, the water source may be a faucet that is external to the base station 100. The faucet may lead to a tap water system of a residential compound or a house. The faucet may be connected to an inlet of the water supply assembly 106 through, for example, a water hose, a water pipe, or the like. A filter may be installed between the external water source and the water supply assembly 106 in order to prevent impurities or harmful substances from entering the base station 100, which could potentially damage the base station 100. In some other embodiments, the water source may be a main water container within the base station, and the main water container may supply water to the cleaning unit via a conduit or the like. The water source may pump clean water (e.g., tap water, distilled water, etc.) to the water supply assembly 106. The self-checking module 108 may be configured to detect a malfunction regarding conveyance of water from the water source to the cleaning unit 104. A pressure regulator may be provided between the water source and the water supply assembly 106, which is configured to regulate the pressure of the water flowing into the water supply assembly 106, so that excessive water pressure damaging the water supply assembly 106 or insufficient water pressure delaying the water supply can be avoided.

Figure 2A:
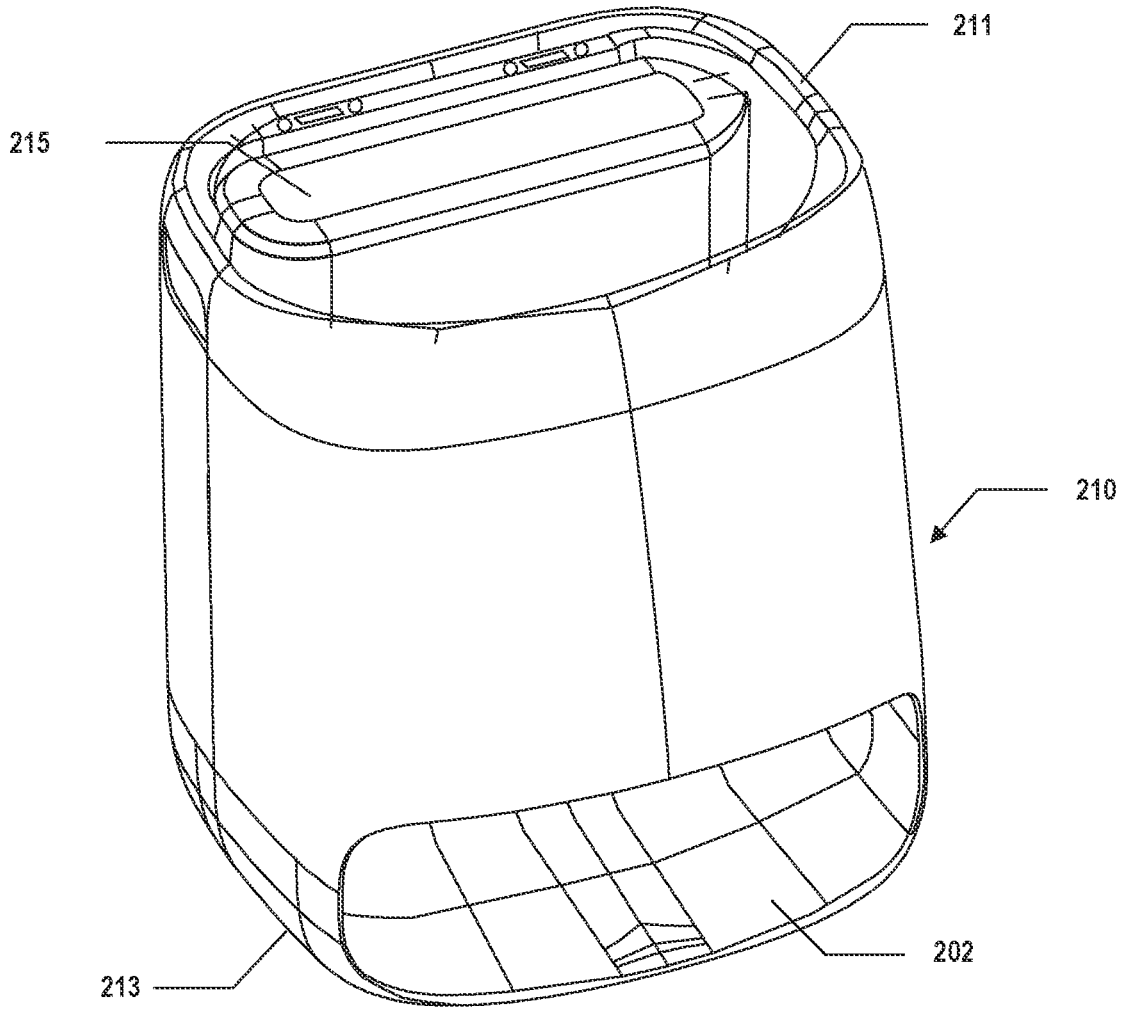
FIG. 2A illustrates an exemplary base station with a front perspective view, according to some aspects of the present disclosure.

Hereinafter, embodiments of the base station according to the present disclosure will be described in conjunction with FIGS. 2A and 2B, which illustrate an exemplary base station 200, according to some aspects of the present disclosure. FIG. 2A is a front perspective view of the base station 200. The base station 200 includes a body 210. The body 210 has an upper portion 211 and a lower portion 213. The lower portion 213 can be placed on a substantially flat surface such that the base station 200 becomes stationary and cannot be easily moved around. The dock 202 is positioned at or near the lower portion 213 of the body 210, and may have an open chamber to accommodate the mobile cleaner. The thickness of the bottom of the body 210 is small enough in order not to jeopardize the mobile cleaner from docking into or undocking from the open chamber of the dock 202.

In some embodiments, as shown in FIG. 2A, the body 210 may include a water tank 215 attached to the inner wall of the body 210. The water tank 215 is configured to accumulate water, so that the water consumed by the cleaning unit 104 can be supplied from the water tank 204 with an adjustable inlet velocity and pressure. In some embodiments, a water tank is not required in certain types of base stations. A base station without the water tank may have a smaller volume than the base station 200 shown in FIGS. 2A and 2B, while water supply to the cleaning unit of the base station will depend on an external water source completely. Although the present embodiments is described with the base station 200 equipped with the water tank 215 as an example, it is understood that these embodiments are not exhaustive of all the embodiments of the present disclosure.

Figure 2B:
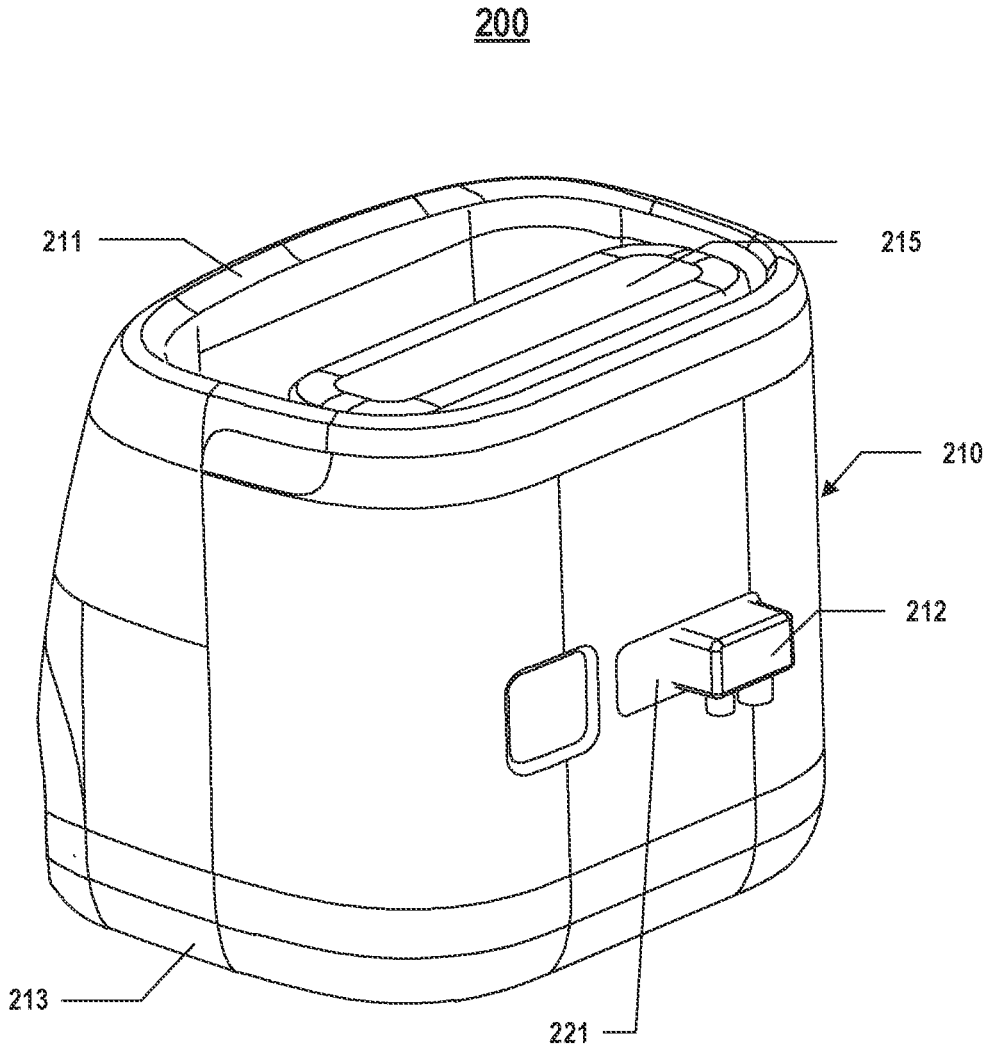
FIG. 2B illustrates the exemplary base station shown in FIG. 2A with a rear perspective view, according to some aspects of the present disclosure.

FIG. 2B is a rear perspective view of the base station 200. In some embodiments, as shown in FIG. 2B, the base station 200 further includes a water inlet 212 on its rear side. The water inlet 212 is positioned in the middle portion of the rear side and protrudes from the body 210. FIG. 2B only illustrates one exemplary configuration of the water inlet 212. In some embodiments, the water inlet 212 may be embedded inside the body 210 without any protrusion, or positioned in the rear side at a place other than the middle portion. The water inlet 212 may be connected to a water source (not shown in FIG. 2A or 2B) outside the body 210 of the base station 200. Internally, the water inlet 212 is connected to the water tank 215 so that a water supply route is established, through which clean water from the water source can be conveyed to the water tank 215.

According to the present disclosure, the base station 200 further includes a cleaning unit and a water supply assembly. The cleaning unit (not shown in FIG. 2A or 2B) may be located inside the body 210. The water supply assembly may include the abovementioned water tank 215 and the water inlet 212. When the water tank 215 is inside the body 210 and the water inlet 212 protrudes outside the body 210, an opening 221 that allows the protrusion is provided on a sidewall of the body 210, as shown in FIG. 2B.

Figure 3:
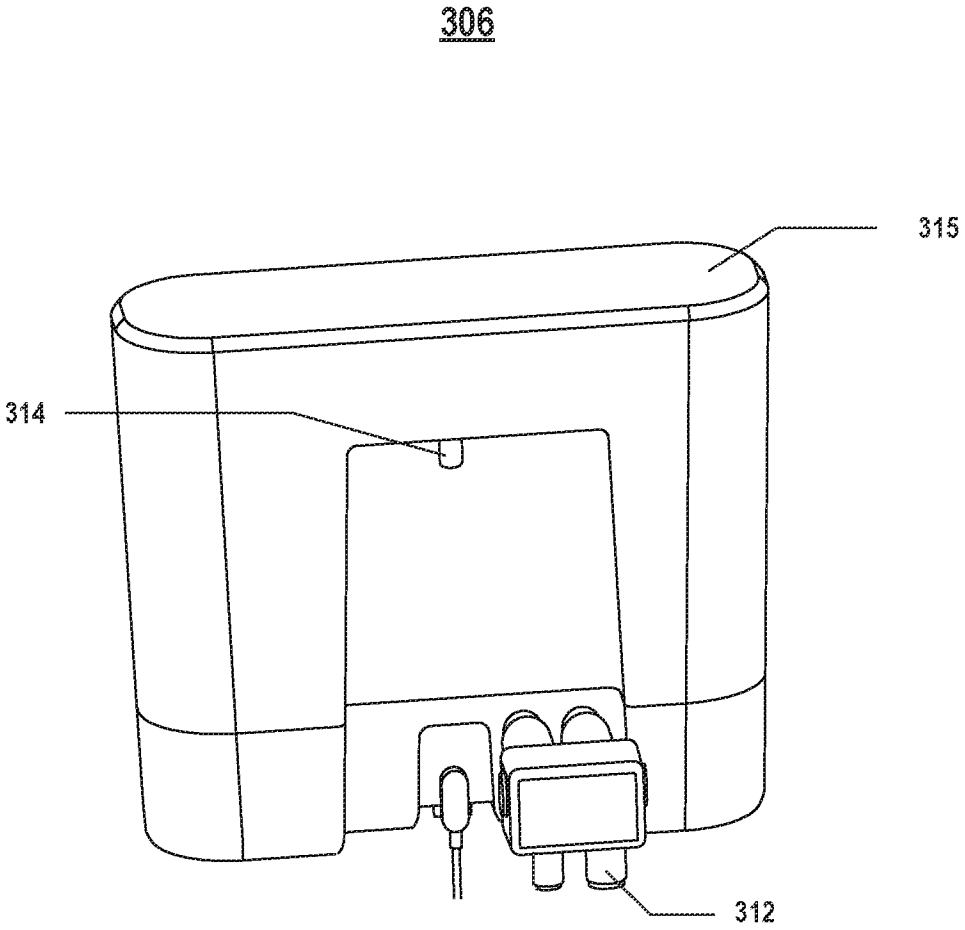
FIG. 3 illustrates an exemplary water supply assembly, according to some aspects of the present disclosure.

FIG. 3 illustrates an exemplary water supply assembly 306, according to some aspects of the present disclosure. The water supply assembly 306 includes a water tank 315, a water inlet 312, and a water outlet 314. The water tank 315 is similar to the water tank 215, and the water inlet 312 is similar to the water inlet 212. The configurations of the water tank and the water inlet are described in detail above in conjunction with FIGS. 2A and 2B and thus will not be repeated herein.

The water outlet 314 is configured to connect the water supply assembly 306 with a cleaning unit (not shown in FIG. 3). The water outlet 314 may supply water stored in the water tank 315 to the cleaning unit so that the mobile cleaner can be washed or sanitized. The inlet velocity and pressure of the water supply can be preset or adjusted manually by the user or automatically by the base station, so that the cleaning efficiency of the cleaning unit can be consistent. The conveyance of water from the water tank 315 to the cleaning unit can be realized by a water pump or an air pump. In the example of an air pump, the water is pushed out of the water tank 315 through compression of the air above the water surface in the water tank 315. In some embodiments, unused water can be directly let out of the base station via a drainage outlet connected to a drainage, a process known as a "draining process." The water outlet 314 may be provided on the same sidewall of the water tank 315 as the water inlet 312, as shown in FIG. 3. It is understood that the positions of the water inlet 312 and the water outlet 314 according to the present disclosure are not limited to those shown in FIG. 3.

Figure 4A:
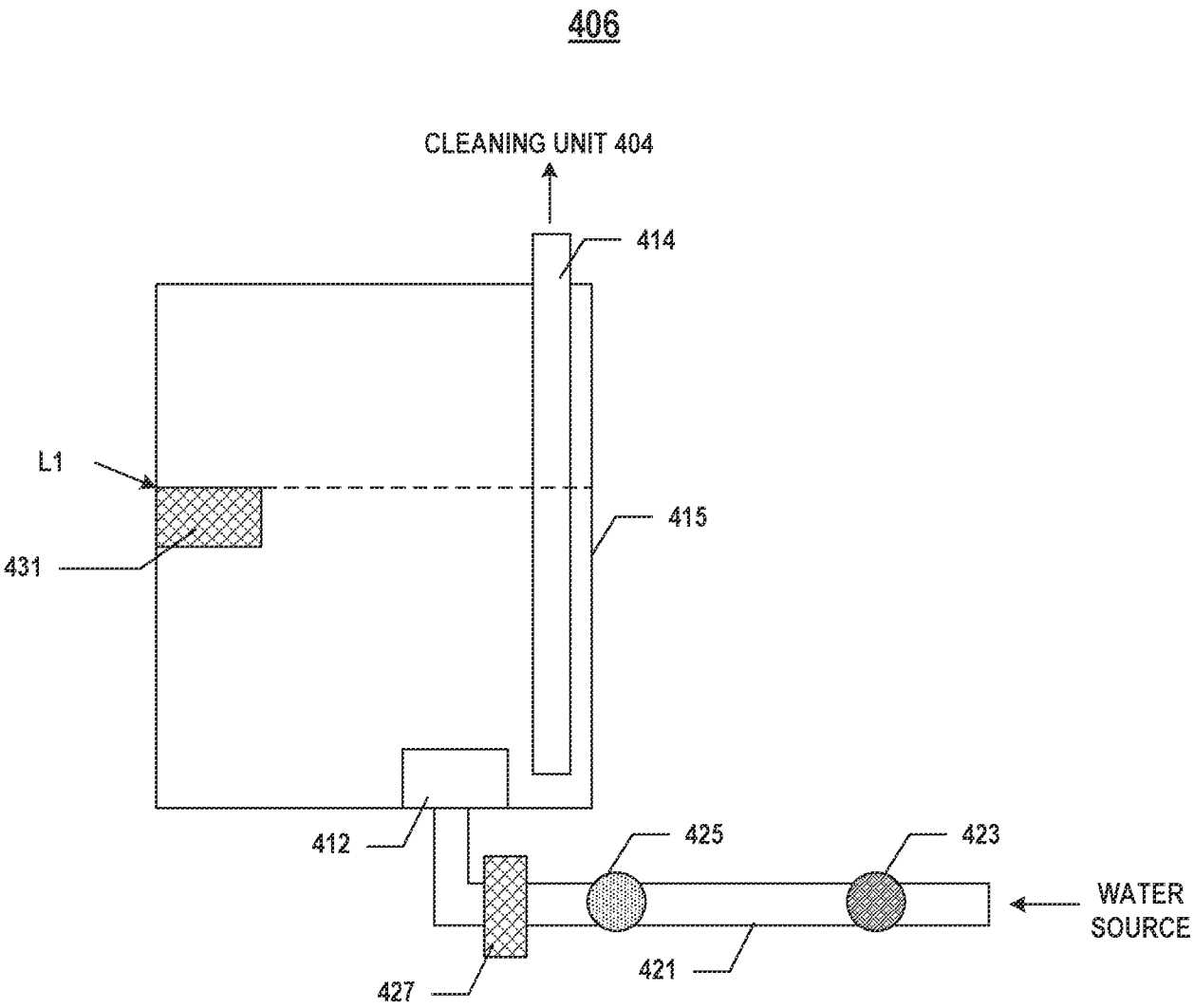
FIG. 4A illustrates a schematic diagram of an exemplary water supply assembly, according to some aspects of the present disclosure.

FIG. 4A illustrates a schematic diagram of an exemplary water supply assembly 406, according to some aspects of the present disclosure. Similar to the examples of water supply assembly described above, the water supply assembly 406 includes a water tank 415, a water inlet 412, and a water outlet 414. As shown in FIG. 4A, the water inlet 412 is close to the bottom of the water tank 415, and the water outlet 414 is close to the top thereof. It is understood that the locations of the inlet and the outlet can be at other places of the water tank 415.

The water tank 415 may accumulate water for cleaning the mobile cleaner. The maximum volume of the water tank 415 is designed to be at least equal to an amount of water needed to clean up the mobile cleaner for one time. In some embodiments, the maximum volume of the water tank 415 is designed to be no more than cleaning up the mobile cleaner twice in order to ensure compactness of the base station. In an example where 500 ml water is needed to clean up the mobile cleaner for one time, the maximum volume of the water tank 415 can be set at least equal to 500 ml. Considering that some water may be left in the tank due to operational redundancy, the maximum volume of the water tank can be designed to exceed 500 ml, such as any volume within the range between 500 ml and 1,000 ml.

The water outlet 414 may have a shape of a tube with two open ends. One of the two open ends ("lower end") is positioned close to the bottom of the water tank 415. Thus, when water is stored in the water tank 415, the lower end is submerged in the water. The other of the two open ends ("upper end") extends out of the water tank 415 and connects to a cleaning unit 404. This configuration allows the water to be easily conveyed from the water tank 415 to the cleaning unit 404 by, for example, water pump, air pump, or capillary action.

The water inlet 412 may be connected to a water source through a pipe 421. The pipe 421 may be made of metal, alloy, plastic, a combination of two or more preceding materials, or any other suitable material. In some embodiments, an anti-spill channel is led to the pipe 421 to drain overflow water in order to protect the base station from being damaged.

In some embodiments, a filter 423 is interposed on the pipe 421 between the water inlet 412 and the water source. The filter 423 can collect impurities and harmful substances in the inflow water and prevent them from entering and damaging the water supply assembly 406. The filter 423 may include a collector for the impurities and harmful substances, The collector may be removable for easy dumping of the collected waste and replacement of the collector.

In some embodiments, a pressure regulator 425 is interposed on the pipe 421 between the water inlet 412 and the water source to regulate the water pressure flowing into the water tank 415. The pressure regulator 425 can increase the water pressure when the water pressure is insufficient or relieve the water pressure when the water pressure is too high, so that the water pressure of the inflow water becomes controllable and relatively stable. The water pressure can be controlled to generate a desired water flow speed, which translates to the time of filling up the water tank 415. Thus, the pressure regulator 425 is a component configured to control the fill-up time of the water tank 415, and the time can be calculated by knowing the water pressure and the maximum volume of the water tank 415. In some embodiments, the pressure regulator 425 is a pressure reducer configured to reduce the water pressure of the inflow water when it is over a threshold value, in order to avoid excessive water pressure damaging the water inlet 412. In some embodiments, the pressure regulator can include multiple components. A portion of the components are located on the pipe 421 while the rest of the components are separately located away from the pipe 421 while being electrically coupled to the components on the pipe 421 through a wired or wireless connection. The user can thus remotely monitor and control the pressure of the water flowing into the water tank 415.

In some embodiments, a valve 427 is interposed on the water pipe 421 between the water inlet 412 and the water source. The valve 427 may be configured with two working states: an "on" state and an "off" state. Water can flow through the valve 427 when it is in the "on" state. Water can be blocked by the valve 427 when it is in the "off" state. The valve 427 may be electrically coupled to and controlled by a controller of the self-checking module (not shown in FIG. 4A) to switch between the "on" and "off" states. The controller is configured to detect the working state of the valve 427 by receiving signals indicating the state of the valve 427 and determines whether the valve is in a correct working state. Once an incorrect working state is detected, the valve 427 is instructed by the controller to shut down the water flow into the water tank 415.

It is noted that the sequence of the valve 427, the pressure regulator 425, and the filter 423 is not limited to the sequence shown in FIGS. 4A-5B and can be any other suitable sequence. For example, one or both of the pressure regulator 425 and the filter 423 can be provided between the water inlet 412 and the valve 427. Those skilled in the art may understand that the specific structures shown in FIGS. 4A-5B do not constitute exhaustive examples of the water supply assembly, which may include more or fewer components than illustrated, combine some of the illustrated components, or have a different component arrangement.

According to the present disclosure, the self-checking module 108 may include one or more types of the following components or functional units: processor, memory, controller, detector, abnormality alarm, and timer. For each type of the component or functional unit included in the self-checking module 108, there can be one or more of the same type of the component or functional unit. In one example, the self-checking module 108 may include one processor, one memory, one controller, four detectors, one abnormality alarm, and one timer. In some embodiments, the self-checking module 108 may be a one-piece structure, for example, a system-on-chip (SoC), that integrates all these components or functional units. In some embodiments, the self-checking module 108 may include components or functional units located at different places of the base station of the cleaning system that do not form an integrated structure.

The processor may include any appropriate type of general-purpose or special-purpose microprocessor, digital signal processor, microcontroller, and graphics processing unit (GPU). The processor may include one or more hardware units (e.g., portion(s) of an integrated circuit) designed for use with other components or to execute part of a program. The program may be stored on a computer-readable medium, and when executed by the processor, it may perform one or more functions disclosed herein. The processor may be configured as a separate processor module dedicated to performing various methods disclosed herein. Alternatively, the processor may be configured as a shared processor module for performing other functions unrelated to the methods disclosed herein.

The memory may include any appropriate type of mass storage provided to store any type of information that the processor may need to operate. For example, the memory may be a volatile or non-volatile, magnetic, semiconductor-based, tape-based, optical, removable, non-removable, or other type of storage device or tangible (i.e., non-transitory) computer-readable medium including, but not limited to a ROM, a flash memory, a dynamic RAM, and a static RAM. The memory may be configured to store one or more computer programs to be executed by the processor to perform various functions disclosed herein. For example, the memory may be configured to store program(s) that may be executed by the processor to perform various methods disclosed herein. The memory may be further configured to store information and data used by the processor.

The controller may be a microcontroller electrically coupled to the processor and the memory. In some embodiments, the microcontroller is a small computer on a single very large-scale integration (VLSI) integrated circuit (IC) chip and contains one or more processors along with memory and programmable input/output peripherals. Alternatively, the controller may be a functional unit implemented by the processor and the memory. The controller may be configured to perform various controlling functions disclosed herein.

The detector may be a flow meter, an anti-overflow detector, a water amount detector, a water level detector, or the like. The detector may detect one or more of the following types of information: water flow, water amount, water level, infrared signal, electrical signal, trigger signal, ultrasonic signal, timing, duration, etc. Coupled with other components of the base station, the types of abnormality of the water supply assembly or the types of malfunction regarding conveyance of water from the water source to the cleaning unit (such as detector failure, lack of water supply, pipeline blockage, water leakage, etc.) can be determined.

The flow meter is used to detect the amount of water flowing into or out of the water tank (e.g., water tank 415). The flow meter may be of a mechanical type or an electromagnetic type. The flow meter can be any one of an infrared sensor, a capacitive sensor, a Hall sensor, an ultrasonic sensor, or the like, or any combination of these sensors. In some embodiments, the flow meter is provided on or near the pipe 421 in order to ensure accurate measurement of the water flow in real time. For example, the flow meter can be positioned between the water inlet 412 and any one of the valve 427, the pressure regulator 425, or the filter 423. A flow meter can also be positioned at or near the water outlet 414 in order to measure the water flowing out of the water supply assembly 406 in real time.

The anti-overflow detector is to detect whether the water overflows from the water tank (e.g., water tank 415). The anti-overflow detector may be of a mechanical type or an electromagnetic type. The anti-overflow detector can be any one of a float valve, a liquid level meter, an infrared sensor, a capacitive sensor, a Hall sensor, an ultrasonic sensor, or the like, or any combination of the preceding ones. The anti-overflow detector may be positioned inside the water tank or near an overflow outlet of the water tank. In an example where a pressure sensor is used as the anti-overflow detector, once the water starts to flow out of the water tank, the sensor is triggered so that the inflow of the water through the water inlet can be stopped.

The water amount detector is used to detect the amount of water stored in the water tank (e.g., water tank 415). The water level detector is used to detect the level of water stored in the water tank (e.g., water tank 415), which in turn indicates the amount of water stored therein. The following description will use the water level detector as an example, but it is understood that the water level detector is interchangeable with the water amount detector and thus the same description applies to the water amount detector as well. The water level detector may be of a mechanical type or an electromagnetic type. The water level detector can be any one of a float valve, a liquid level meter, an infrared sensor, a capacitive sensor, a Hall sensor, an ultrasonic sensor, or the like, or any combination of the preceding ones. The water level detector may be provided inside the water tank. In one example shown in FIG. 4A, a water level detector 431 may be attached to the inside wall of the water tank 415. The water level detector 431 may be triggered once the water level reaches level L1. L1 is a water level indicates that enough water has filled in the water tank 415 for cleaning the mobile cleaner. The water level detector may have multiple parts, and some of the parts may be provided inside or near the water tank while the other parts are remotely coupled to the parts. In some embodiments where the water level detector is submerged in the water, it is designed to be waterproof.

The abnormality alarm is used to notify the base station, the cleaning system, or a user of the base station or the cleaning system that there is a malfunction in the station or the system regarding conveyance of water from the water source to the cleaning unit. The station or the system may perform operations corresponding to the type of malfunction so identified. The abnormality alarm may be a component or function unit of the base station or the cleaning system. Alternatively, it may be separately provided and apart from the base station or the cleaning device. The abnormality alarm can be any one of an acousto-optic alarm device, a display screen, a notification application installed on the base station, a notification application installed on a terminal device capable of communication with the base station, or the like, or any combination of the preceding ones. In the example of an acousto-optic alarm device, the notification may be a warning light, a buzzer sound, etc. The terminal device may be a cell phone equipped with the application that manifests the abnormality.

The timer is a typical component of a computer system. It is configured to calculate time intervals or frequency, and often includes comparison logic to compare the timer value with a preset value that triggers a specific action when the timer value matches or exceeds the preset value. The timer may be coupled to one or more of the processor, the controller, the detector, or the abnormality alarm. In some embodiments, when the detector receives an output from the timer indicating that a certain malfunction regarding water conveyance has occurred, the controller can instruct the valve (e.g., valve 427) to turn off. Coupled with a flow meter, the timer can assist in determining the existence or the velocity of a water flow into the water supply assembly. Coupled with a water level detector, the timer can assist in determining whether a water level has reached a preset threshold, and if so, a corresponding operation (e.g., turning off the valve) is triggered.

Figure 4B:
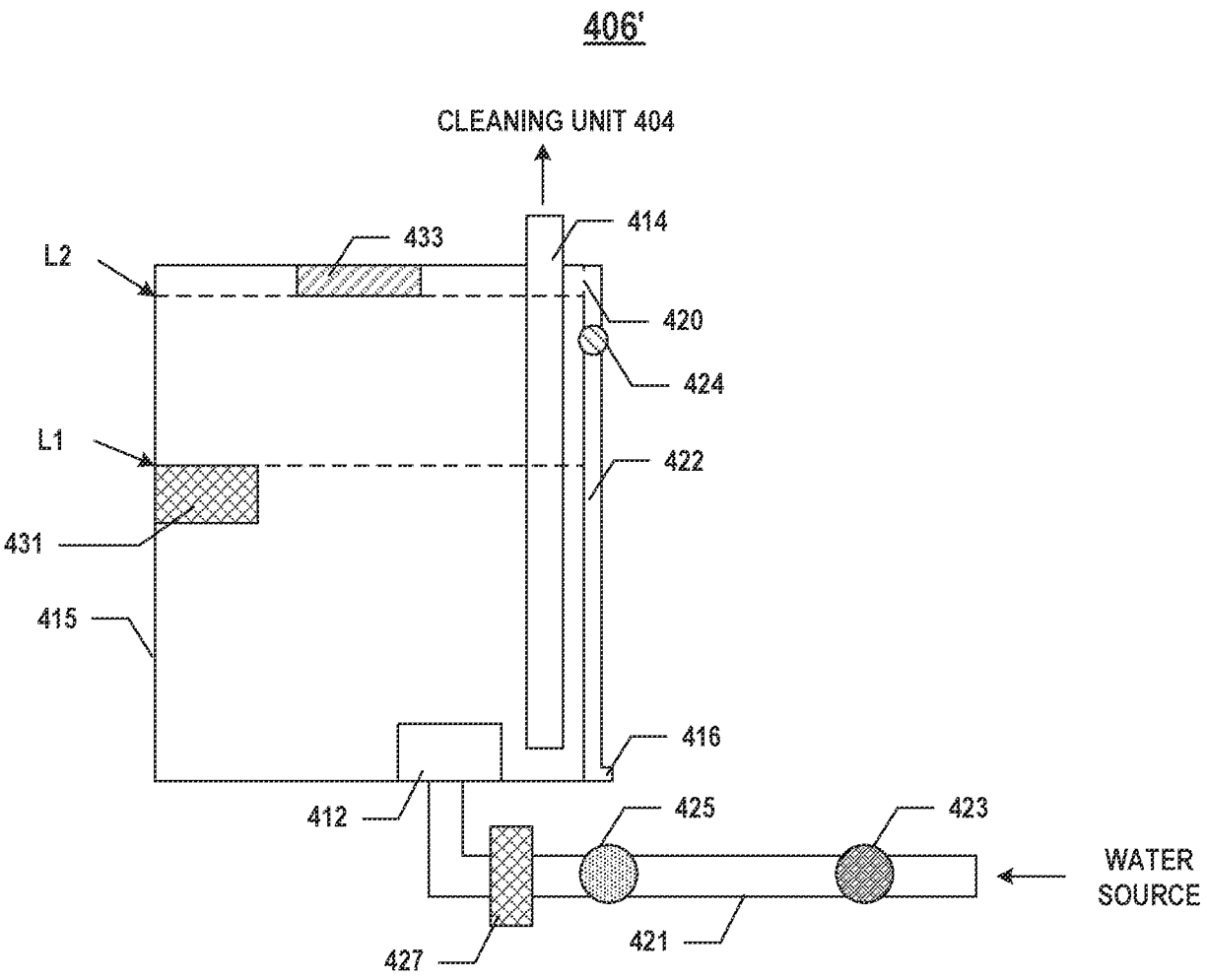
FIG. 4B illustrates a schematic diagram of another exemplary water supply assembly, according to some aspects of the present disclosure.

FIG. 4B illustrates a schematic diagram of another exemplary water supply assembly 406', according to some aspects of the present disclosure. The water supply assembly 406' differs from the water supply assembly 406 in that a second water level detector 433 is attached therein. As shown in FIG. 4B, the second water level detector 433 may be positioned inside the water tank 415 at a location higher than the first water level detector 431. Thus, the water level triggering the second water level detector 433 (namely, water level L2 shown in FIG. 4B) is higher than that triggering the first water level detector 431 (namely, water level L1 shown in FIGS. 4A and 4B). L2 is a water level indicating that the water in the water tank 415 will soon overflow if water continues to fill in. L2 may be set slightly lower than e level of a full tank of water, so that the self checking module may have sufficient time to react (such as by turning off the valve 427 near the water inlet 412) before the overflow occurs. In some embodiments, the value of L2 may be set according to the location of the second water level detector 433 in the water tank.

In some embodiments, the water supply assembly 406' may further include a drain 420 and a pipe 422 for draining excessive water out of the water supply assembly 406' via a drainage outlet 416. The excessive water may damage components of the base station and the mobile cleaner once it leaks into them, especially electronic components. The drain 420 may be mounted on an inner sidewall of the water tank 415. In some embodiments, the drain is close to the top of the water tank 415, as shown in FIG. 4B, so that only water above a certain water level can be drained. The pipe 422 may extend from the top to the bottom of the water tank 415 to allow water to be easily drained via gravity through the drainage outlet 416. The excessive water may be led out of the water tank 415 through other configurations. For example, the pipe 422 can be dispensed with, so that the excessive water can directly flow out of the drain 420 and along the outer sidewall of the water tank 415. Alternatively, the pipe 422 may be mounted on the outer sidewall of the water tank 415, in which case the drainage outlet 416 is not required.

in some embodiments, an anti-overflow detector 424 may be provided in the water supply assembly 406'. For example, as shown in FIG. 4B, the anti-overflow detector 424 may be located at a position close to an opening of the drain 420, so that as soon as water overflows into the drain 420, the anti-overflow detector 424 can be triggered. The triggered anti-overflow detector 424 may generate a spill-over signal that allows the self-checking module to turn off the valve 427 and to stop the water supply via the water inlet 412.

Figure 4C:
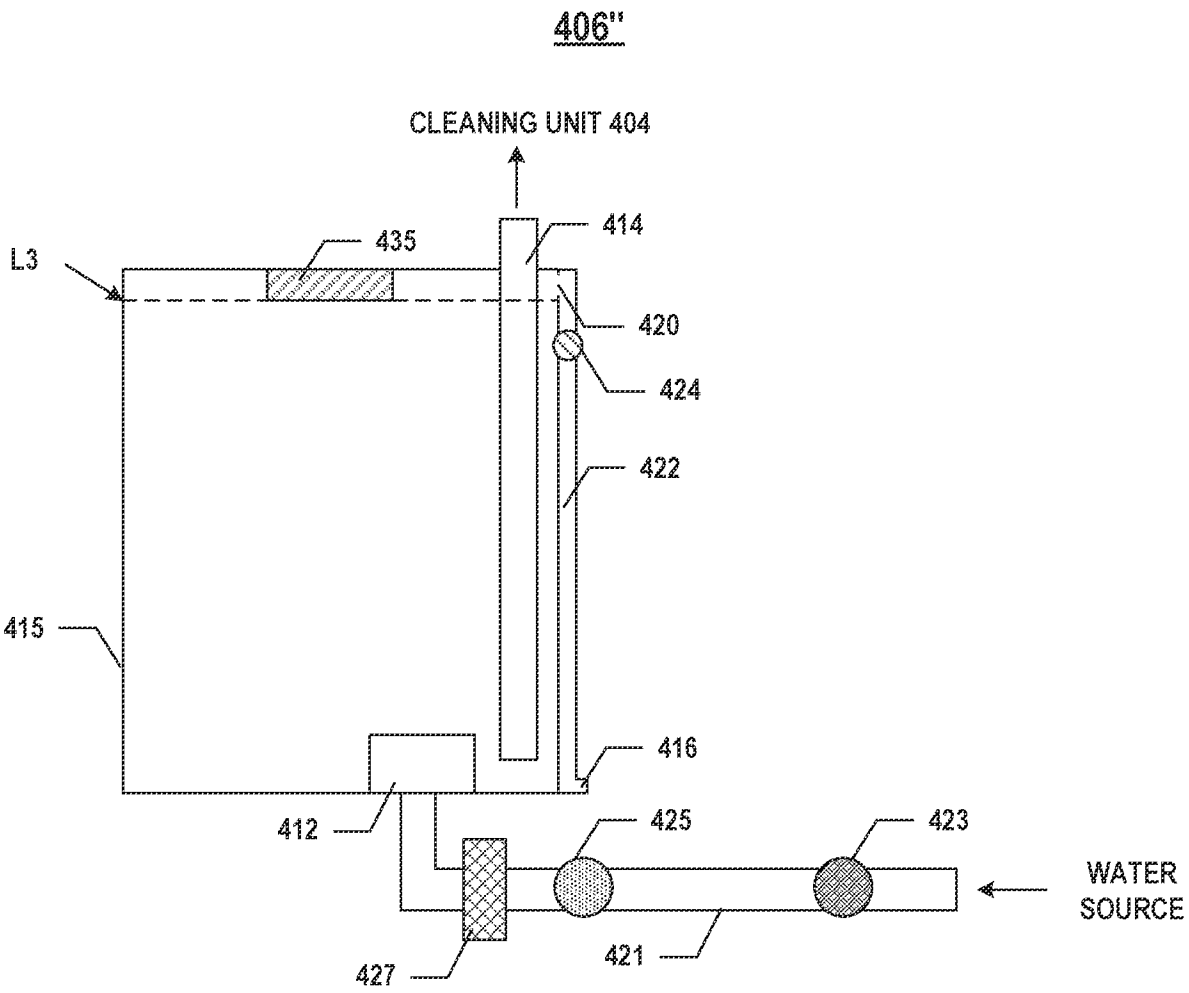
FIG. 4C illustrates a schematic diagram of yet another exemplary water supply assembly, according to some aspects of the present disclosure.

In some embodiments, the first level detector 431 can be dispensed with, as shown in FIG. 4C, which illustrates a schematic diagram of yet another exemplary water supply assembly 406", according to some aspects of the present disclosure. The water supply assembly 406" includes a third water level detector 435. The water level detector 435 may be attached inside the water tank 415 at a location close to its top. In some embodiments, the third water level detector 435 may be positioned at the same location as the second water level detector 433 in the water supply assembly 406'. The third water level detector 435 may perform one or both functions of the first water level detector 431 and the second water level detector 433 described herein. In some embodiments, similar to the second water level detector 433, a water level L3 correlated to the water level detector 435 may indicate that the water in the water tank 415 will soon overflow if water continues to fill in. In some embodiments, when the maximum volume of the water tank is only slightly larger than the amount of water necessary for cleaning up the mobile cleaner for one time, the first water level L1 and the second water level L2 shown in FIG. 4B can be merged into the third water level L3. Thus, water level reaching L3 means that enough water has filled in the water tank 415 and continuous inflow will soon cause overflow of the water. Although not having as broad applications as the water supply assembly 406', water supply assembly 406" with a single water level detector has the advantage of reduced material cost and less probability of malfunction due to its composition of fewer electronic components.

Figure 5A:
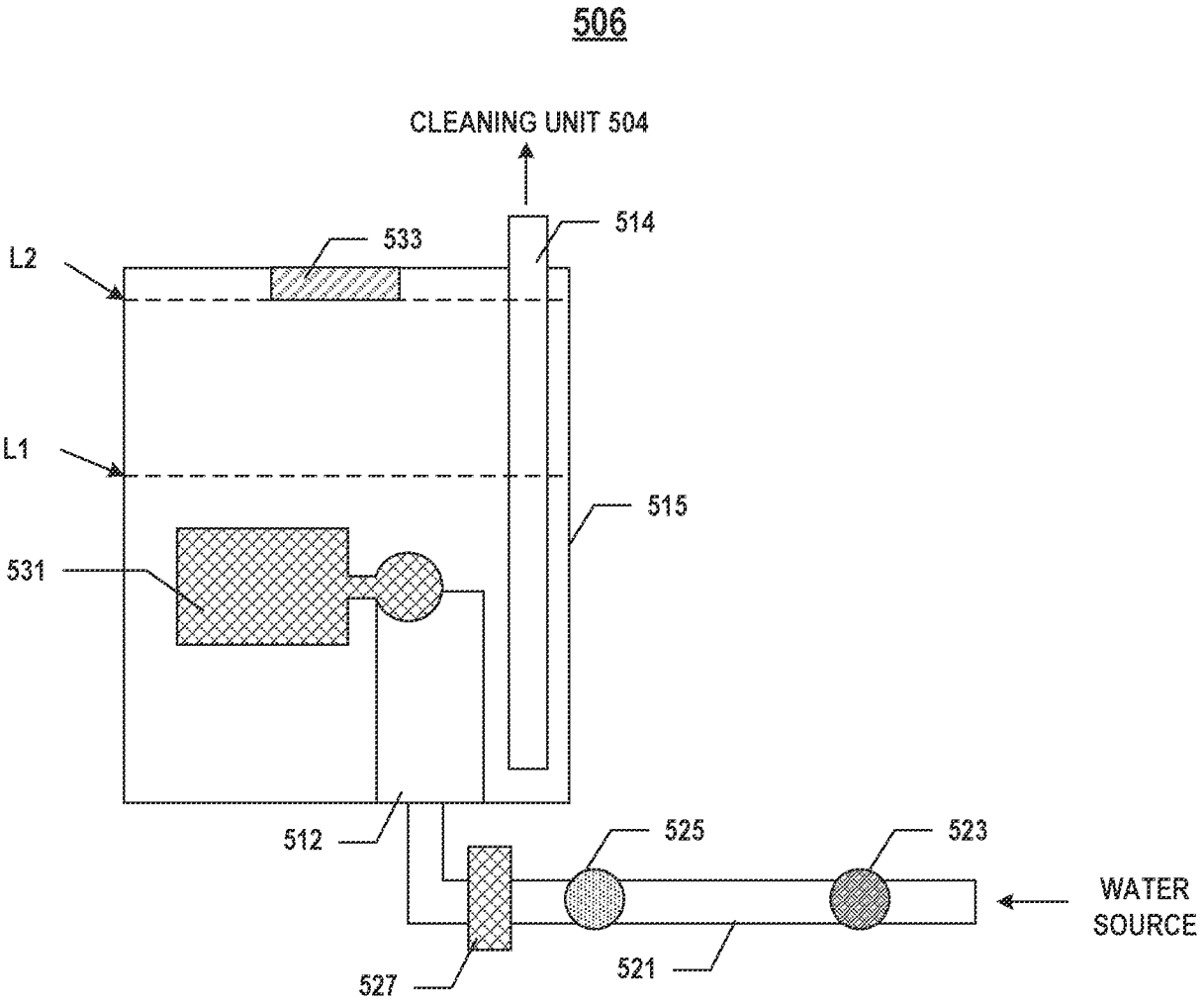
FIG. 5A illustrates a schematic diagram of still another exemplary water supply assembly, according to some aspects of the present disclosure.

FIG. 5A illustrates a schematic diagram of still another exemplary water supply assembly 506, according to some aspects of the present disclosure. Similar to the water supply assembly 406 and the water supply assembly 406', the water supply assembly 506 includes a water tank 515, a pipe 521, a filter 523, a pressure regulator 525, a valve 527, a water inlet 512, and a water outlet 514. A first water level detector 531 and a second water level detector 533 of the water supply assembly are provided inside the water tank 515. It is understood that this is only one exemplary illustration of the water supply assembly according to the present disclosure, and is not intended to limit the scope thereof.

Figure 5B:
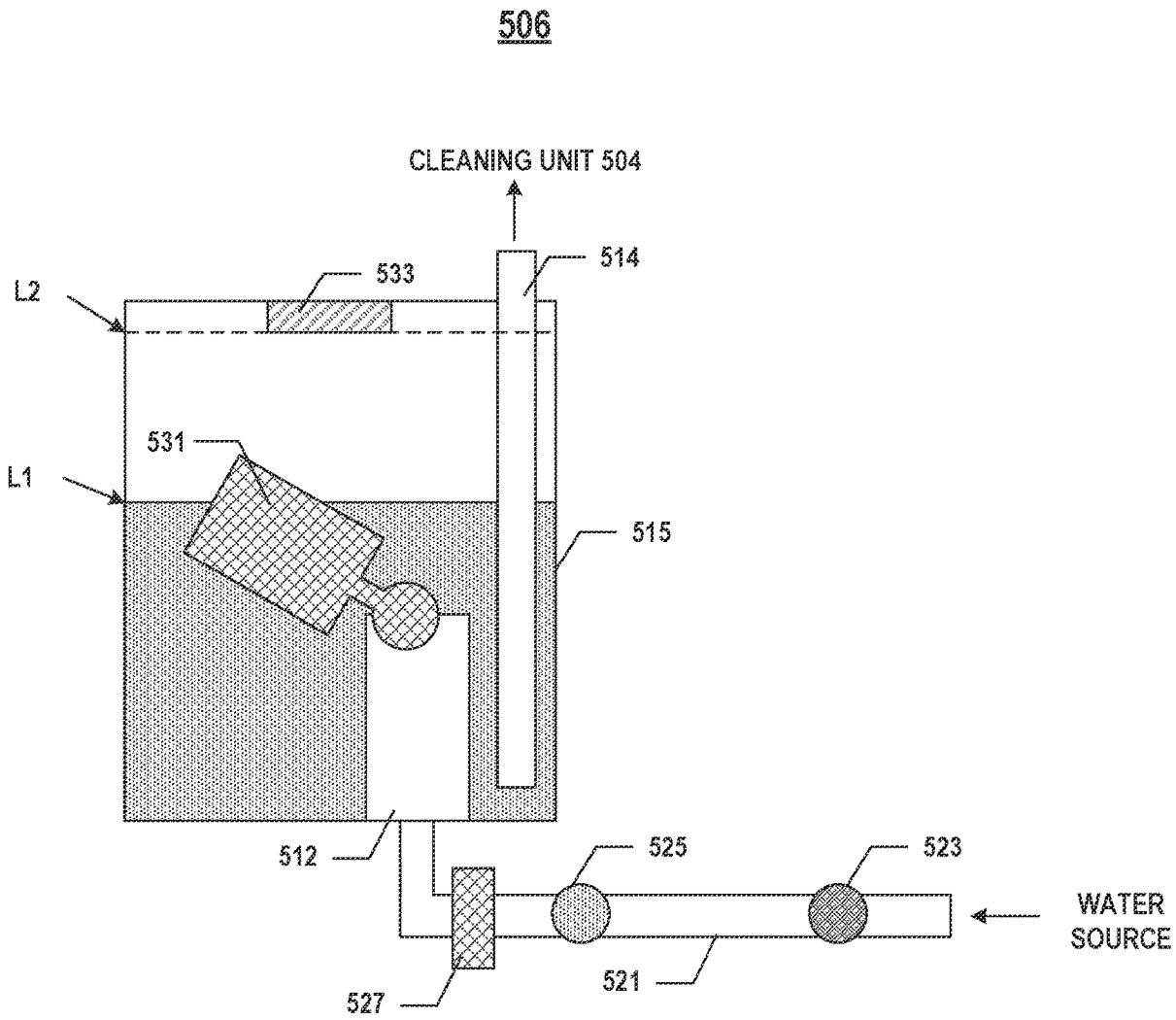
FIG. 5B illustrates a schematic diagram of the exemplary water supply assembly shown in FIG. 5A in a different state, according to some aspects of the present disclosure.

Unlike the embodiments in FIGS. 4A and 4B, the first water level detector 531 in FIGS. 5A and 5B is a float-valve type. FIG. 5B illustrates a schematic diagram of the exemplary water supply assembly 506 shown in FIG. 5A in a different state, according to some aspects of the present disclosure. As the water continues to fill in the water tank 515, the gravity center of the float-valve detector 531 gradually moves up, along with the water level, until the water level reaches L1. In some embodiments, the float-valve detector 531 also functions as a mechanical valve, so that when the water level reaches L1, the water inlet 512 is blocked by the float-valve detector 531 to prevent water from further flowing into the water tank 515.

As discussed above, a cleaning system according to the present disclosure may include both a mobile cleaner and a base station. In some embodiments, the base station and the mobile cleaner are not the only parts that constitute the cleaning system. For example, the cleaning system may also include a power supply assembly. The power supply assembly is configured to supply power to the base station. The electrical power could trigger water conveyance mechanism, such as a water pump or an air pump. As a result, the base station is able to convey water into, within, or out of the water supply assembly. The power supply assembly may be an internal battery pack (such as a battery pack inside the base station), or receive AC power from an external power source (such as residential power lines). According to the present disclosure, the power supply assembly may provide sufficient electrical power for one or more of the following operations: for the cleaning unit to wash or sanitize the mobile cleaner; for the base station to charge the mobile cleaner; for the self-checking module to detect abnormality; for the base station or the cleaning system to notify the malfunction; for the base station or the cleaning system to perform operations corresponding to the type of malfunction so identified.

Figure 6:
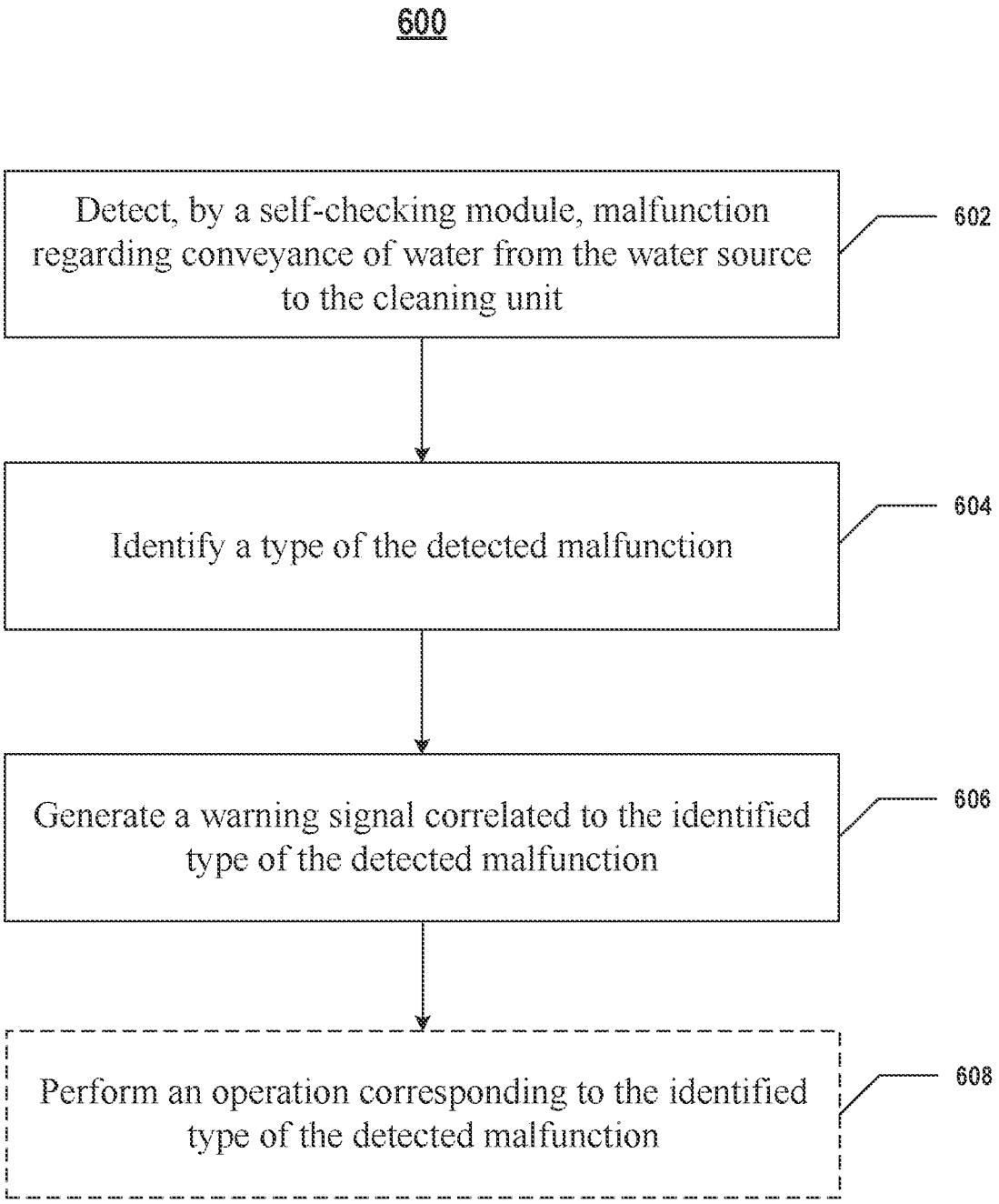
FIG. 6 illustrates a flowchart of an exemplary method for self-checking a base station for a mobile cleaner, according to some aspects of the present disclosure.

FIG. 6 is a schematic flowchart of an exemplary method 600 for self-checking a base station for a mobile cleaner, according to some aspects of the present disclosure. The method 600 will be described in conjunction with the various parts and components of the base station introduced above. The base station can be any of the base stations described herein, such as the base station 100 or the base station 200. The mobile cleaner can be any of the mobile cleaners described herein, such as a cleaning robot, a hand-held vacuum, or a vacuum-mop robot. The self-checking method 600 can be implemented by a self-checking module of the base station, such as the self-checking module 108. It is understood that the operations shown in method 600 are not exhaustive and that other operations can be performed as well before, after, or between any of the illustrated operations. Further, some of the operations may be performed simultaneously, or in a different order than that shown in FIG. 6.

According to the present disclosure, the base station includes a dock (e.g., dock 102) that accommodates the mobile cleaner. Once docked, the mobile cleaner may be cleaned by a cleaning unit (e.g., cleaning unit 104) with water supplied from a water source to the cleaning unit via a water supply assembly (e.g., water supply assembly 106). In some embodiments, the cleaning of the mobile cleaner may start after a certain amount of water is supplied and stored in the water supply assembly (e.g., in the water tank 415). Alternatively, the cleaning may start simultaneously with the water supply, as long as the speed of water supply outpaces the speed of water usage by the cleaning unit. The speed of the water supply may be measured by a flow meter provided at or near a water inlet (e.g., water inlet 412) of the water supply assembly, also known as the "inlet velocity." The speed of the water usage may be measured by a flow meter provided at or near a water outlet (e.g., water outlet 414) of the water supply assembly, thus also known as the "outlet velocity." The water supply assembly may include a valve controlling the amount and speed of the water filling in the water supply assembly via the water inlet. It may also include a water pump or an air pump at or near the water outlet to drive the water from the water supply assembly to the cleaning unit, and the speed of the outgoing water may be controlled by the water pump or the air pump (e.g., depending on the pressure applied to the water by the pump). It may further include one or more detectors (such as the first water level detector 431/531, the second water level detector 433/533, etc.) to detect the amount of water stored in the water supply assembly.

Under normal conditions, the valve, the one or more detectors, and the one or more flow meters all work properly to ensure that water is safely conveyed from the water source to the cleaning unit. In one example, when the water level reaches a first threshold value (e.g., water level L1), the valve may be controlled to stop the water supply to the water supply assembly. In another example, when the water level reaches a second threshold value (e.g., water level L2) which is equal to or higher than the first threshold value, the valve may also be controlled to stop the water supply to the water supply assembly. In yet another example, when the inlet or outlet velocity of the water supply assembly deviates from a default velocity range according to the feedback from the one or more flow meters, the pressure regulator may be controlled to adjust the velocity so that it returns to the default velocity range. However, sometimes a malfunction may occur, which needs to be addressed in a convenient and efficient manner.

At Step 602, the method 600 detects, by the self-checking module, a malfunction regarding conveyance of water from the water source to the cleaning unit. In some embodiments, the malfunction is detected by one or more sensors provided in the base station, such as the first detector 431/531, the second detector 433/533, the flow meter, etc. When timing signals are necessary for comparison with a threshold timing value, the timer is also relied upon in carrying out the detection. In some embodiments, when the one or more sensors themselves fail, the self-checking module can detect a malfunction by way of lack of output signals from the sensors. Some examples of the malfunction detectable by the self-checking module according to the present disclosure are lack of water supply, pipeline blockage, water leakage, sensor failure, installation abnormality, etc.

At Step 604, the method 600 identifies a type of the detected malfunction. The identification may be performed by the self-checking module or a processor executing computer instructions stored in a memory. With the advanced product design and innovative utilization of various sensors, the present disclosure is capable of recognizing multiple types of malfunction and distinguishing them from each other. The identification may be carried out by the self-checking module. In some embodiments, a processor of the self-checking module is able to receive feedbacks from the various sensors, compare the feedbacks with the types of malfunction stored in the memory, and determine if there is a match to any type. If so, the type of malfunction is thus identified. At Step 606, the method 600 generates a warning signal correlated to the identified type of the detected malfunction. The warning signal may be generated by the self-checking module. In some embodiments, the warning signal may come from an abnormality alarm. The following describes in detail how each type of the detected malfunction is identified and how each warning signal correlated to the identified type of the detected malfunction is generated, according to certain aspects of the present disclosure.

In some embodiments, the valve (e.g., valve 427/527) is checked to see if it is in a correct working state, if not, the valve is determined to malfunction. For example, when the base station is powered on, the method 600 runs a quick diagnosis of the status of the valve, which is supposed to be electrically connected. If no electrical connection is established with the valve, it is determined that the valve is not in a correct working state. Alternatively, when the base station is powered off, the valve is supposed to be disconnected from electrical power. If electrical connection to the valve is detected it is determined that the valve is not in a correct working state. The diagnosis or the self-checking can be periodically conducted for multiple times, so that any malfunction of the valve can be immediately detected, thereby reducing the impact of malfunction caused by valve failure.

In response to the detection result that the valve is not in a correct working state, the method 600 may generate a first warning signal correlated to the detected result. This type of malfunction may be categorized as a Type I malfunction. In some embodiments, the first warning signal is disseminated by the abnormality alarm (e.g., an acousto-optic alarm device) in the form of buzzer sound, warning light, periodical flash, etc. This allows the user to be easily noticed of the abnormality.

In some embodiments, the inlet velocity of water supply is an important factor of a user's concern. If the inlet velocity is too slow (or even zero), it may take too long for the water supply assembly to replenish the water accumulated in the water tank. This could delay cleaning of the mobile cleaner, thus hampering its ability to quickly return to operation after being washed or sanitized while docked at the base station. If the inlet velocity is too high, the water tank is prone to overflow, thus damaging the water supply assembly and the base station. Neither instance is desirable. According to the present disclosure, the inlet velocity of water supply can be measured by a first flow meter provided at or near the water inlet of the water supply assembly. For example, the inlet velocity can be calculated based on a cross-sectional area of the water inlet and a pressure of the incoming water flow. The controller may compare the detected inlet velocity with a default inlet velocity to determine whether the difference is beyond a first margin. In one example, the default inlet velocity of water supply is preset at 50 ml per second. The first margin can be a numerical value (e.g., any value between 0 ml per second and 25 ml per second) or a percentage value (e.g., any value between 0% and 50%). A user can set the default inlet velocity and the first margin according to the actual needs, both of which can be saved in the memory. In the example above, when the first margin is set at 20 ml per second or 40%, a water supply inlet velocity lower than 30 ml per second or higher than 70 ml per second will be determined to be beyond the first margin.

In response to the comparison result that the detected inlet velocity deviates from the default inlet velocity beyond the first margin, the method 600 may generate a second warning signal correlated to the result. This type of malfunction may be categorized as a Type II malfunction. Same as the Type I malfunction, in some embodiments, the second warning signal is also disseminated by the abnormality alarm, albeit the form of notification may be different from that for the Type I malfunction, such as emitting a different color of warning light or airing a buzzer sound of different pitch or interval. Alternatively, the intensity of the second warning signal may be proportional to the extent of deviation. For example, the more the detected inlet velocity deviates from the default inlet velocity, the louder the buzzer sound is. This enhances the effect of notification in case of emergency.

Figure 7:
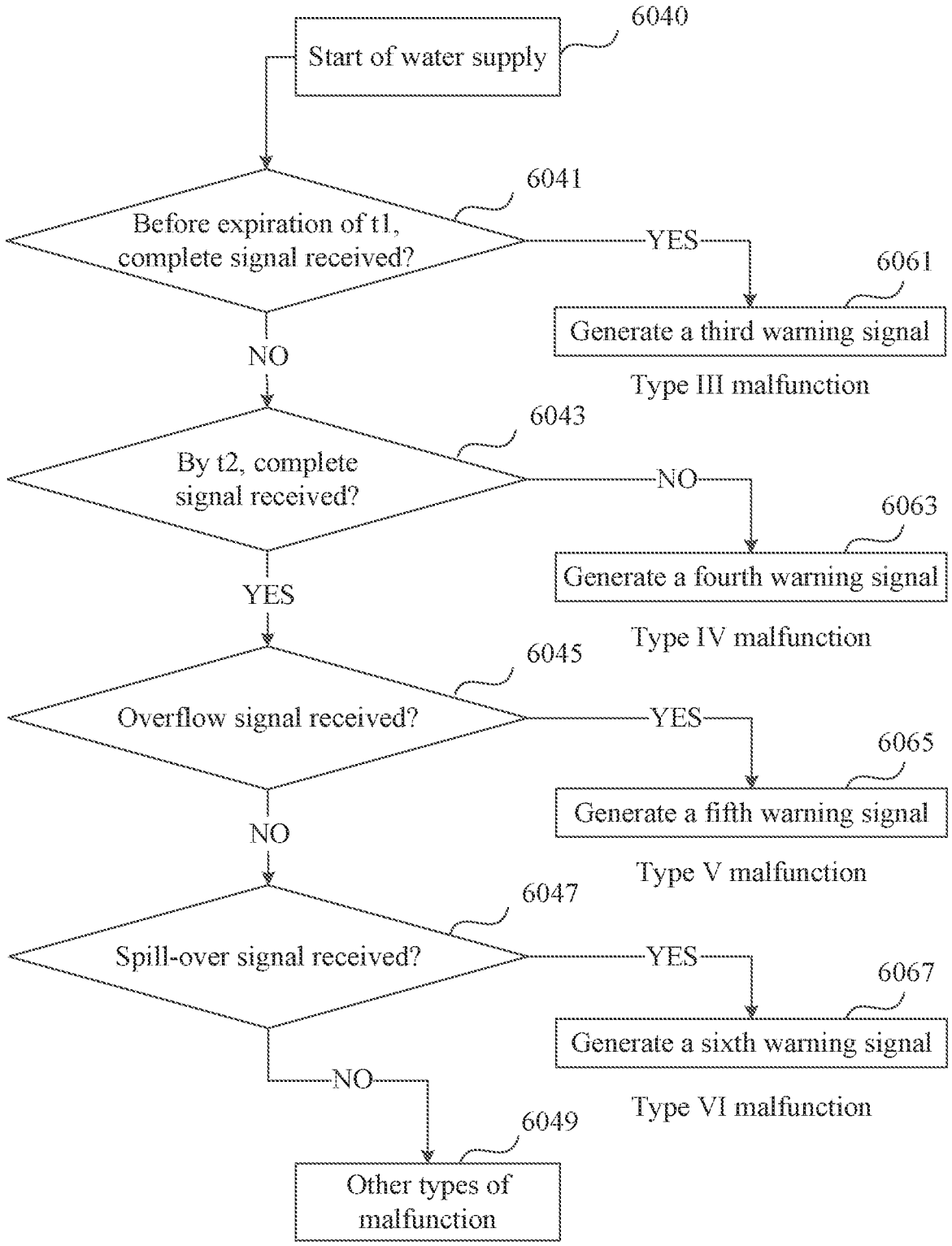
FIG. 7 illustrates a flowchart of an example of identifying a type of the detected malfunction and generating a warning signal, according to some aspects of the present disclosure.

FIG. 7 illustrates a flowchart of an example 605 of identifying a type of the detected malfunction and generating a warning signal, according to some aspects of the present disclosure. As discussed in FIGS. 4A to 5B, the self-checking module according to the present disclosure may include a first water level detector (such as the water level detector 431/531), which is configured to detect an amount of water accumulated in the water tank (such as the water tank 415/515) of the water supply assembly (such as the water supply assembly 406/406'/506). The first water level detector may generate a complete signal when the water accumulated therein reaches a first level (such as the level L1), indicating that enough water has filled in the water tank for cleaning the mobile cleaner. The complete signal may be sent to, for example, the processor of the self-checking module. Alternatively, other parts of the base station may be configured to receive the complete signal. In some embodiments, while water is filling in the water tank, a timer calculates a duration T between the start of the water supply and receipt of the complete signal. The timer can be any of the timers described herein. The duration T is compared with a first preset period t1, a second preset period t2, a third preset period t3, so that the self-checking module is able to identify additional types of malfunction.

As shown in FIG. 7, at Step 6040, the water supply starts. In some embodiments, the first preset period t1 can be set as a time value that is a quotient of a water amount divided by an inlet velocity. The water amount is the amount of water that brings the water level in the water tank to L1, and the inlet velocity is the maximum inlet velocity allowed for filling in an empty water tank. As an example, L1 represents an amount of water of 840 ml in the water tank, and the inlet velocity is 70 ml per second. Thus, the first preset period t1 can be set as 12 seconds. In some embodiments, the first preset period t1 can be adjusted by a user according to actual needs.

At Operation 6041, a determination is made as to whether the complete signal generated by the first water level detector is received before expiration of the first time period t1. Under normal conditions, the water level is supposed not to reach L1 (and thus no complete signal is received) until the first preset period t1 expires. When either the self-checking module or any other component of the base station receives the complete signal before the first preset period t1 expires (e.g., received in less than 12 seconds in the above example), a malfunction may have occurred. For example, high inlet velocity, non-empty water tank, or failure of the first water level detector could have resulted in such a malfunction, which may be categorized as a Type III malfunction. In some embodiments, some of the causes can be identified as causes for other types of malfunction and thus eliminated from the causes for the current type of malfunction. For example, the high inlet velocity can be determined to cause the Type II malfunction and thus, if a second warning signal is received, the same issue of high inlet velocity cannot trigger the Type III malfunction. This saves time of subsequent checking and repairing by the user.

At Operation 6061, in response to the determination that the complete signal is received before the expiration of the first preset period t1, the method 600 may generate a third warning signal correlated to the result. Same as the Type I and Type II malfunctions, in some embodiments, the third warning signal is also disseminated by the abnormality alarm, albeit the form of notification may be different from those for the Type and Type II malfunctions, such as emitting a different color of warning light or airing a buzzer sound of different pitch or interval.

At Operation 6043, a determination is made as to whether the complete signal is received after the second preset period t2 has passed. In some embodiments, the second preset period t2 can be set as a time value that is a quotient of a water amount divided by an inlet velocity. Similar to the first preset period t1, the water amount is the amount of water that brings the water level in the water tank to L1. But unlike the first preset period t1, the inlet velocity is the minimum inlet velocity allowed for filling in an empty water tank. Thus, in such embodiments, the second preset period t2 is longer than the first preset period t1. In some other embodiments, the two preset periods t1 and t2 can also be equal. For example, where the inlet velocity is constant without variation, the two preset periods t1 and t2 are the same. In some embodiments, the second preset period t2 can be adjusted by a user according to actual needs.

Hereinafter use the same L1 (840 ml) in Operation 6041 as an example, but the inlet velocity is now 30 ml per second. Thus, the first preset period t1 can be set as 28 seconds. Under normal conditions, the water level is supposed to reach L1 (and thus the complete signal is received) by the time the second preset period t2 is reached. When neither the self-checking module nor any other component of the base station receives the complete signal after the second preset period t2 has passed (e.g., not received after 28 seconds in the above example), a malfunction may have occurred. For example, low inlet velocity, leakage in the water supply assembly, blockage of pipeline, or failure of the first water level detector could have resulted in such a malfunction, which may be categorized as a Type IV malfunction. In some embodiments, some of the causes can be identified as causes for other types of malfunction and thus eliminated from the causes for the current type of malfunction. For example, the low inlet velocity can be determined to cause the Type II malfunction and thus, if a second warning signal is received, it cannot trigger the Type IV malfunction. This saves time of subsequent checking and repairing by the user.

At Operation 6063, in response to the determination that the complete signal is not received after the second preset period t2 has passed, the method 600 may generate a fourth warning signal correlated to the result. Same as the Type I to Type III malfunctions, in some embodiments, the fourth warning signal is also disseminated by the abnormality alarm, albeit the form of notification may be different from those for the Type I through Type III malfunctions, such as emitting a different color of warning light or airing a buzzer sound of different pitch or interval.

Aside from the above abnormal scenarios, if the complete signal generated by the first water level detector is received between the expiration of the first preset time period t1 and that of the second preset time period t2, the self-checking module may determine that the first water level detector functions properly and that no indication of malfunction in the base station or the cleaning system is perceived. In some embodiments, the self-checking module may proceed with determination of other types of malfunction.

As discussed in FIGS. 4B to 5B, the self-checking module according to the present disclosure may include a second water level detector (such as the water level detector 433/533), which is configured to detect whether the water is about to overflow from the water tank (such as the water tank 415/515) of the water supply assembly (such as the water supply assembly 406'/506). The second water level detector may generate an overflow signal when the water accumulated therein reaches a second level (such as the level L2, which is higher than level L1), indicating that the water in the water tank will soon overflow if water continues to fill in. Similar to the complete signal, the overflow signal may be sent to, for example, the processor of the self-checking module. Alternatively, other parts of the base station may be configured to receive the overflow signal.

At Operation 6045, a determination is made as to whether the overflow signal generated by the second water level detector is received. Under normal conditions, the water level in the water tank is kept below the level L2, so that the base station or the cleaning system, especially the electronic components contained therein, will not be damaged by excessive water seeping into them. This can be achieved by, for example, stopping the water inflow when the first level L1 is reached. However, when the overflow signal is received, a malfunction may have occurred. For example, high inlet velocity, non-empty water tank, or failure of the valve could have resulted in such a malfunction, which may be categorized as a Type V malfunction. In some embodiments, some of the causes can be identified as causes for other types of malfunction and thus eliminated from the causes for the current type of malfunction. For example, the high inlet velocity can be determined to cause the Type II malfunction and thus, if a second warning signal is received, it cannot trigger the Type V malfunction. This saves time of subsequent checking and repairing by the user.

Hereinafter use the same L1 (840 ml) in Operation 6041 as an example, and L2 represents an amount of water of 960 ml in the water tank. When the second water level detector generates an overflow signal indicating that the amount of water has reached 960 ml, one possibility is that the first water level detector has not triggered the stoppage of water inflow by, for example, instructing the valve (e.g., valve 427/527) to shut down the water inflow. In this scenario, the second water level detector functions as a failsafe mechanism that prevents water from spilling out of the water tank.

At Operation 6065, in response to the determination that the overflow signal is received, the method 600 may generate a fifth warning signal correlated to the result. Same as the Type I to Type IV malfunctions, in some embodiments, the fifth warning signal is also disseminated by the abnormality alarm, albeit the form of notification may be different from those for the Type I through Type IV malfunctions, such as emitting a different color of warning light or airing a buzzer sound of different pitch or interval.

In some embodiments, the second water level can be set to be equal to the first water level. For example, this could happen in a case where the maximum volume of the water tank of the waters supply assembly is only slightly larger than the amount of water necessary for cleaning up the mobile cleaner for one time. Thus, the first water level detector and the second water level detector can mutually serve as a failsafe mechanism for the other. That is, when a complete signal is received while an overflow signal is not received, the second water level detector may have malfunctioned; and when an overflow signal is received while a complete signal is not received, the first water level detector may have malfunctioned. This configuration advantageously allows the self-checking module to automatically identify failure of a particular sensor.

As discussed in FIG. 4B, the self-checking module according to the present disclosure may include an anti-overflow detector (such as the anti-overflow detector 424), which is configured to detect whether water actually overflows from the water tank (such as the water tank 415/515) of the water supply assembly (such as the water supply assembly 406'/506). The anti-overflow detector may generate a spill-over signal when the water starts to flow out of the water tank via, for example, a drain (such as the drain 420). Similar to the complete signal and the overflow signal, the spill-over signal may be sent to, for example, the processor of the self-checking module. Alternatively, other parts of the base station may be configured to receive the spill-over signal.

At Operation 6047, a determination is made as to whether the spill-over signal is received. Under normal conditions, thanks to the existence of one or both of the first water level detector and the second water level detector, the water accumulated in the water tank is kept at a level that does not exceed the maximum volume of the water tank. However, when the spill-over signal is received, a malfunction may have occurred. For example, high inlet velocity, non-empty water tank, or failure of the second water level detector could have resulted in such a malfunction, which may be categorized as a Type VI malfunction. In some embodiments, some of the causes can be identified as causes for other types of malfunction and thus eliminated from the causes for the current type of malfunction. For example, the high inlet velocity can be determined to cause the Type II malfunction and thus, if a second warning signal is received, it cannot trigger the Type VI malfunction. This saves time of subsequent checking and repairing by the user. When the anti-overflow detector is triggered, one possibility is that neither the first water level detector nor the second water level detector has triggered the stoppage of water inflow. In this scenario, the anti-overflow detector functions as an additional layer of the fail safe mechanism that prevents water from continuously spilling out of the water tank.

At Operation 6067, in response to the determination that the spill-over signal is received, the method 600 may generate a sixth warning signal correlated to the result. Same as the Type I to Type V malfunctions, in some embodiments, the sixth warning signal is also disseminated by the abnormality alarm, albeit the form of notification may be different from those for the Type I through Type V malfunctions, such as emitting a different color of warning light or airing a buzzer sound of different pitch or interval.

In the event that none of the above Type III to VI malfunctions is identified, the method 600 moves to identify other types of malfunction at Operation 6049.

It is noted that the operations shown in FIG. 7 do not necessarily have to be performed in the order shown or all be performed. In some embodiments, the operations can be performed simultaneously, or in a different order. In some embodiments, some of the operations can be omitted. For example, when water supply is stopped after Operations 6043 and 6063, Operations 6045, 6065, 6047, or 6067 may not occur.

In some embodiments, the outlet velocity of water supply is another important factor of a user's concern. If the outlet velocity is too slow or even zero (indicating lack of water supply to the cleaning unit), it may take too long for the water supply assembly to convey water to the cleaning unit, or the water pressure in the cleaning unit is insufficient to be sprayed to the mobile cleaner, thus reducing the effectiveness of the cleaning process. This could delay cleaning of the mobile cleaner, thus hampering its ability to quickly return to operation after being washed or sanitized while docked at the base station. If the outlet velocity is too high, the cleaning unit is prone to overflow, thus damaging the cleaning unit and the mobile cleaner, or the water is used up too quickly before the cleaning up of the mobile cleaner is completed. Neither instance is desirable. According to the present disclosure, the outlet velocity of water supply can be measured by a second flow meter provided at or near the water outlet of the water supply assembly. For example, the outlet velocity can be calculated based on a cross-sectional area of the water outlet and a pressure of the outgoing water flow. The controller may compare the detected outlet velocity with a default outlet velocity to determine whether the difference is beyond a second margin. In one example, the default outlet velocity of water supply is preset at 10 ml per second. The second margin can be a numerical value (e.g., any value between 0 ml per second and 5 ml per second) or a percentage value (e.g., any value between 0% and 50%). A user can set the default outlet velocity and the second margin according to the actual needs, both of which can be saved in the memory. In the example above, when the first margin is set at 4 ml per second or 40%, a water supply outlet velocity lower than 6 ml per second or higher than 14 ml per second will be determined to be beyond the second margin.

In response to the comparison result that the detected outlet velocity deviates from the default outlet velocity beyond the second margin, the method 600 may generate a seventh warning signal correlated to the result. This type of malfunction may be categorized as a Type VII malfunction. Same as the Type I to VI malfunctions, in some embodiments, the seventh warning signal is also disseminated by the abnormality alarm, albeit the form of notification may be different from that for the Type I to VI malfunctions, such as emitting a different color of warning light or airing a buzzer sound of different pitch or interval. Alternatively, the intensity of the seventh warning signal may be proportional to the extent of deviation. For example, the more the detected outlet velocity deviates from the default outlet velocity, the louder the buzzer sound is. This enhances the effect of notification in case of emergency.

In some embodiments, a malfunction can be detected by the second water level detector and a timer, with or without the first level detector. In such embodiments, a determination is made as to whether the overflow signal is received after the third preset period t3 has passed. Under normal conditions, the second water level detector (such as the second water level detector 433/533 or the third water level detector 435 serving in replace of the first and second water level detectors) may generate an overflow signal when the water accumulated therein reaches a second level (such as the level L2 or level L3, which is higher than level L1), indicating that the water in the water tank will soon overflow if water continues to fill in. As discussed above, the overflow signal may be sent to, for example, the processor of the self-checking module. Alternatively, other parts of the base station may be configured to receive the overflow signal. Upon receipt of the overflow signal, the water inflow can be stopped so that the base station or the cleaning system, especially the electronic components contained therein, will not be damaged by excessive water seeping into them.

However, if no overflow signal is received after the third preset period t3, a malfunction may have occurred. For example, lack of or insufficient water supply, or failure of one or more of the first water level detector or the second water level detector could have resulted in such a malfunction, which may be categorized as a Type VIII malfunction. The third preset period t3 can be set as a time value that is a quotient of a water amount divided by an inlet velocity. The third preset period t3 may be equal to or longer than the second preset period t2. Hereinafter use the same L2 (960 ml) as an example, the third preset period t3 can be a time period when the water level should have reached at L2 with the lowest acceptable inlet velocity (e.g., 30 ml per second). Thus, the third preset period t3 is 32 seconds. That is to say, if no overflow signal is received after 32 seconds, one or more of the following causes may have contributed to this: (1) lack of water from the water source (e.g., faucet); (2) pipeline leakage that reduces inlet velocity; (3) failure of the first water level detector that does not trigger the valve to shut down; or (4) failure of the second water level detector that does not trigger the valve to shut down.

In some embodiments, some of the causes can be identified as causes for other types of malfunction and thus eliminated from the causes for the current type of malfunction. For example, the failure of the second water level detector can be determined to cause the Type V malfunction and thus, if a fifth warning signal is received, it cannot trigger the Type V malfunction. This saves time of subsequent checking and repairing by the user. In response to the determination that the overflow signal is not received after the third preset period t3 has passed, the method 600 may generate an eighth warning signal correlated to the result. Same as the Type I to Type VII malfunctions, in some embodiments, the eighth warning signal is also disseminated by the abnormality alarm, albeit the form of notification may be different from those for the Type I through Type VII malfunctions, such as emitting a different color of warning light or airing a buzzer sound of different pitch or interval.

Referring to FIG. 6, according to the present disclosure, after the type of the detected malfunction is identified, method 600 optionally includes an additional step—Step 608—of performing an operation corresponding to the identified type of the detected malfunction. In some embodiments, after one or more of the first, second, third, fourth, fifth, sixth, seventh, and eighth warning signals are received, the controller may be controlled to turn off the valve, so that water will not flow into the water supply assembly, allowing the base station, the cleaning system, or a user of the base station or the cleaning system to inspect the cause for the detected malfunction. In some embodiments, if the malfunction is related to water velocity, such as Type II and VII malfunctions, the self-checking module or the processor of the base station or the cleaning system may instruct a pressure regulator (e.g., the pressure regulator 425) to change the water pressure coming into the water inlet or going out of the water outlet of the water supply assembly, so that the inlet velocity or the outlet velocity of the water can be adjusted. In some embodiments, if sensor failure is identified to cause the malfunction, such as Type III, IV, V, VI, and VIII malfunctions, the base station or the cleaning system may isolate the failed sensor and notify the user to replace it. In some embodiments, if the malfunction is related to excessive amount of water accumulated in the water tank, such as Type V and VI malfunctions, the self-checking module or the processor of the base station or the cleaning system may start a water draining process, enabled by, for example, the anti-spill channel, so that the accumulated water can recede to a level not triggering the warning signals.

Although the above descriptions use an abnormality alarm as an example of notifying warning signals, it is understood that the present disclosure includes other forms of such notification. In some embodiments, the mobile cleaner or the base station may include a screen. The screen is configured to display various system and operation information, including the notification of the warning signals. For example, when a warning signal is generated by the self-checking module, it can be displayed on such a screen. In some embodiments, acousto-optic signals may be emitted from the mobile cleaner, instead of being emitted from the base station as described above, so that the user can hear or see the signal while the mobile cleaner is in his or her proximity and the base station is far away. The notification can be triggered by a wireless signal (such as via Bluetooth, Wi-Fi, WLAN, cellular network, etc.) transmitted from the self-checking module of the base station to the mobile cleaner. This makes the notification process more flexible and effective.

In some embodiments, a terminal device e.g., smartphone, tablet, wearable electronics, etc.) may be provided to remotely communicate with the base station, the mobile cleaner, or the cleaning system, according to the present disclosure. The terminal device may be pre-installed with software and hardware configured to transmit wireless signals (such as via Bluetooth, Wi-Fi, WLAN, cellular network, etc.) between itself and the base station, the mobile cleaner, or the cleaning system. The wireless signals may contain control signal, notification signal regarding malfunction, system status signal, etc. With respect to the notification signal regarding malfunction, the wireless signal may be transmitted from the mobile cleaner, the base station, or the cleaning system to the terminal device to notify the user of the specific type of malfunction, according to the type of warning signal so received. In some embodiments, the notification signal may trigger a sound, a vibration, or a screen display of the terminal device specifically configured to each type of malfunction, and thus the user can quickly recognize the type of malfunction.

According to one aspect of the present disclosure, a base station for a mobile cleaner is disclosed. The base station includes a dock, a cleaning unit, a water assembly, and a self-checking module. The dock is configured to accommodate the mobile cleaner. The cleaning unit is configured to clean the mobile cleaner accommodated in the dock. The water supply assembly is configured to supply water to the cleaning unit from a water source. The self-checking module is configured to detect a malfunction regarding conveyance of water from the water source to the cleaning unit.

In some implementations, the self-checking module is further configured to identify a type of the detected malfunction and generate a warning signal correlated to the type of the detected malfunction.

In some implementations, the water supply assembly includes an inlet connected to the water source, an outlet connected to the cleaning unit, and a water tank configured to accumulate water conveyed from the water source through the inlet and to supply water to the cleaning unit through the outlet.

In some implementations, a valve is positioned between the inlet and the water source. The self-checking module includes a controller electrically coupled to the valve and configured to control the valve.

In some implementations, the self-checking module is configured to detect a correct working state of the valve, and generate a first warning signal when the valve is not in the correct working state.

In some implementations, the self-checking module includes a first flow meter configured to detect an inlet velocity of the water conveyed into the water tank through the water inlet. The self-checking module is configured to compare the detected inlet velocity with a default inlet velocity, and generate a second warning signal when the detected inlet velocity deviates from the default inlet velocity beyond a first margin.

In some implementations, the self-checking module includes a first water level detector configured to detect an amount of water accumulated in the water tank. The first water level detector generates a complete signal in response to the amount of water accumulated in the water tank reaching a first water level.

To some implementations, when the complete signal is received from the first water level detector before expiration of a first preset period, the self-checking module is configured to generate a third warning signal.

In some implementations, when the complete signal is not received from the first level detector after a second preset period has passed, the self-checking module is configured to generate a fourth yarning signal. The second preset period is equal to or longer than the first preset period.

In some implementations, the self-checking module includes a second water level detector configured to detect an amount of seater accumulated in the water tank. The second water level detector generates an overflow signal in response to the amount of water accumulated in the water tank reaching a second water level.

In some implementations, the second water level is equal to or higher than the first water level.

In some implementations, when the overflow signal is received from the second water level detector, the self-checking module is figured to generate a fifth warning signal.

In some implementations, the self-checking module includes an anti-overflow detector configured to generate a spill-over signal in response to the water overflowing from the water tank. When the spill-over signal is received, the self-checking module is configured to generate a sixth warning signal.

In some implementations, the self-checking module includes a second flow meter configured to detect an outlet velocity of the water conveyed out of the water tank through the outlet. The self-checking module is configured to compare the detected outlet velocity with a default outlet velocity, and generate a seventh warning signal in response to the detected outlet velocity deviating from the default outlet velocity beyond a second margin.

In some implementations, when the overflow signal is not received from the second level detector after a third preset period has passed, the self-checking module is configured to generate an eighth warning signal. The third preset period is equal to or longer than the second preset period.

In some implementations, the mobile cleaner is one of a mobile cleaning robot, a handheld vacuum, or a vacuum-mop robot.

In some implementations, a user of the mobile cleaner is notified of at least one of the first, second, third, fourth, fifth, sixth, and seventh warning signals. The notification is in at least one of the following forms:

- displaying on a screen of the mobile cleaner,
- displaying on a screen of the base station,
- emitting an acoustic signal from the mobile cleaner audible by the user,
- emitting an optic signal from the mobile cleaner viewable by the user,
- emitting an acoustic signal from the base station audible by the user,
- emitting an optic signal from the base station viewable by the user,
- transmitting a wireless signal from the mobile cleaner to a terminal device of the user, or
- transmitting a wireless signal from the base station to a terminal device of the user.

In some implementations, upon receipt of at least one of the first, second, third, fourth, fifth, sixth, and seventh warning signals, the controller turns off the valve.

According to another aspect of the present disclosure, a cleaning system is disclosed. The cleaning system includes a base station, a power supply assembly, and a mobile cleaner. The base station includes a dock, a cleaning unit, a water supply assembly, and a self-checking module. The power supply assembly is configured to supply power to the base station. The dock is configured to accommodate the mobile cleaner and charge the mobile cleaner via the power supply assembly. The cleaning unit is configured to clean the mobile cleaner accommodated in the dock. The water supply assembly is configured to supply water to the cleaning unit from a water source. The self-checking module is configured to detect a malfunction regarding conveyance of water from the water source to the cleaning unit.

In some implementations, the self-checking module is further configured to identify a type of the detected malfunction and generate a warning signal correlated to the type of the detected malfunction.

In some implementations, according to the type of the detected malfunction, the power supply assembly stops one or both of supplying power to the base station or charging the mobile cleaner.

According to yet another aspect of the present disclosure, a method for self-checking a base station for a mobile cleaner is disclosed. The base station includes a water supply assembly configured to supply water to a cleaning unit from a water source. The method includes detecting, by a self-checking module, a malfunction regarding conveyance of water from the water source to the cleaning unit.

In some implementations, the method further includes identifying a type of the detected malfunction, and generating a warning signal correlated to the type of the detected malfunction.

In some implementations, the water supply assembly includes an inlet connected to the water source, an outlet connected to the cleaning unit, and a water tank configured to accumulate water conveyed from the water source through the inlet and to supply water to the cleaning unit through the outlet.

In some implementations, a valve is positioned between the inlet and the water source. The method further includes detecting a correct working state of the valve, and in response to the valve not being in the correct working state, generating a first warning signal.

In some implementations, the method further includes detecting an inlet velocity of the water conveyed into the water tank through the water inlet, comparing the detected inlet velocity with a default inlet velocity, and in response to the detected velocity deviating from the default inlet velocity beyond a first margin, generate a second warning signal.

In some implementations, the method further includes detecting an amount of water accumulated in the water tank, and generating a complete signal in response to the amount of water accumulated in the water tank reaching a first water level.

In some implementations, the method further includes, in response to the complete signal being received before expiration of a first preset period, generating a third warning signal.

In some implementations, the method further includes, in response to the complete signal being not received after a second preset period has passed, generating a fourth warning signal.

In some implementations, the second preset period is equal to or longer than the first preset period.

In some implementations, the method further includes detecting an amount of water accumulated in the water tank, generating an overflow signal in response to the amount of water accumulated in the water tank reaching a second water level, and in response to the overflow signal being received, generating a fifth warning signal.

In some implementations, the second water level is equal to or higher than the first water level.

In some implementations, the method further includes generating a spill-over signal in response to the water overflowing from the water tank, and in response to the spill-over signal being received, generate a sixth warning signal.

In some implementations, the method further includes detecting an outlet velocity of the water conveyed out of the water tank through the water outlet, comparing the detected outlet velocity with a default outlet velocity, and generating a seventh warning signal in response to the detected outlet velocity deviating from the default outlet velocity beyond a second margin.

In some implementations, the method further includes, in response to the overflow signal not being received after a third preset period has passed, generating an eighth warning signal. The third preset period is equal to or longer than the second preset period.

In some implementations, the method further includes notifying a user of the mobile cleaner of at least one of the first, second, third, fourth, fifth, sixth, and seven warning signals. The notification is in at least one of the following forms:

displaying on a screen of the mobile cleaner, displaying on a screen of the base station, emitting an acoustic signal from the mobile cleaner audible by the user, emitting an optic signal from the mobile cleaner viewable by the user, emitting an acoustic signal from the base station audible by the user, emitting an optic signal from the base station viewable by the user, emitting a wireless signal from the mobile cleaner to a terminal device of the user, or transmitting a wireless signal from the base station to a terminal device of the user.

In some implementations, the method further includes turning off the valve upon receipt of at least one of the first, second, third, fourth, fifth, sixth, and seventh warning signals In some implementations, the method further includes adjusting the inlet velocity and the outlet velocity of the water respectively upon receipt of one of the second and seventh warning signals.

In some implementations, the method further includes isolating a failed sensor identified by the self-checking module, and notifying a user of the mobile cleaner of the failed sensor.

In some implementations, the method further includes starting a draining process to cause the water accumulated in the water tank to recede to a level not triggering the fifth warning signal or the sixth warning signal.

The foregoing description of the specific implementations can be readily modified and/or adapted for various applications. Therefore, such adaptations and modifications are intended to be within the meaning and range of equivalents of the disclosed implementations, based on the teaching and guidance presented herein.

The breadth and scope of the present disclosure should not be limited by any of the above-described exemplary implementations but should be defined only in accordance with the following claims and their equivalents.

What is claimed is:

1. A base station for a mobile cleaner, comprising: a dock configured to accommodate the mobile cleaner; a cleaning unit configured to clean the mobile cleaner accommodated in the dock; a water supply assembly configured to supply water to the cleaning unit from a water source, wherein the water supply assembly comprises: an inlet connected to the water source, an outlet connected to the cleaning unit, and a water tank configured to accumulate water conveyed from the water source through the inlet and to supply water to the cleaning unit through the outlet; and a self-checking module configured to detect a malfunction regarding conveyance of water from the water source to the cleaning unit, wherein the self-checking module comprises: a memory configured to store a computer program; a processor configured to execute the computer program to perform functions of the self-checking module; a first water level detector configured to detect an amount of water accumulated in the water tank, and to generate a complete signal in response to the amount of water accumulated in the water tank reaching a first water level, wherein when the complete signal is received from the first water level detector before expiration of a first preset period, the self-checking module is configured to generate, by the processor, a type-I warning signal; when the complete signal is not received from the first level detector after a second preset period has passed, the self-checking module is configured to generate, by the processor, a type-II warning signal; and wherein the second preset period is equal to or longer than the first preset period.

2. The base station of claim 1, further comprising a valve positioned between the inlet and the water source, wherein the self-checking module comprises a controller electrically coupled to the valve and configured to control the valve, and wherein the self-checking module is configured to detect a correct working state of the valve, and generate, by the processor, a type-III warning signal when the valve is not in the correct working state.

3. The base station of claim 1, wherein the self-checking module comprises a first flow meter configured to detect an inlet velocity of the water conveyed into the water tank through the inlet, and wherein the self-checking module is configured to compare, by the processor, the detected inlet velocity with a default inlet velocity, and generate, by the processor, a type-IV warning signal when the detected inlet velocity deviates from the default inlet velocity beyond a first margin.

4. The base station of claim 1, wherein the self-checking module comprises a second water level detector configured to detect an amount of water accumulated in the water tank, wherein the second water level detector generates an overflow signal in response to the amount of water accumulated in the water tank reaching a second water level, and the second water level is equal to or higher than the first water level; and wherein, when the overflow signal is received from the second water level detector, the self-checking module is configured to generate, by the processor, a fifth warning signal.

5. The base station of claim 4, wherein, when the overflow signal is not received from the second level detector after a third preset period has passed, the self-checking module is configured to generate, by the processor, an eighth warning signal, and the third preset period is equal to or longer than the second preset period.

6. The base station of claim 1, wherein the self-checking module comprises an anti-overflow detector configured to generate a spill-over signal in response to the water overflowing from the water tank, and wherein, when the spill-over signal is received, the self-checking module is configured to generate, by the processor, a sixth warning signal.

7. The base station of claim 1, wherein the self-checking module comprises a second flow meter configured to detect an outlet velocity of the water conveyed out of the water tank through the outlet, and wherein the self-checking module is configured to compare, by the processor, the detected outlet velocity with a default outlet velocity, and generate, by the processor, a seventh warning signal in response to the detected outlet velocity deviating from the default outlet velocity beyond a second margin.

8. The base station of claim 1, wherein a user of the mobile cleaner is notified of at least one of the type-I and type-II warning signals, and wherein the notification is in at least one of the following forms: displaying on a screen of the mobile cleaner, displaying on a screen of the base station, emitting an acoustic signal from the mobile cleaner audible by the user, emitting an optic signal from the mobile cleaner viewable by the user, emitting an acoustic signal from the base station audible by the user, emitting an optic signal from the base station viewable by the user, transmitting a wireless signal from the mobile cleaner to a terminal device of the user, or transmitting a wireless signal from the base station to the terminal device of the user.

* * * * *